US009021937B2

(12) United States Patent
Sugamoto et al.

(10) Patent No.: US 9,021,937 B2
(45) Date of Patent: May 5, 2015

(54) RECIPROCATING COMPRESSOR

(75) Inventors: Yoko Sugamoto, Osaka (JP); Masaru Matsui, Kyoto (JP); Fuminori Sakima, Osaka (JP); Ko Inagaki, Shiga (JP); Akira Nakano, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 825 days.

(21) Appl. No.: 13/259,022

(22) PCT Filed: Mar. 24, 2010

(86) PCT No.: PCT/JP2010/002094

§ 371 (c)(1),
(2), (4) Date: Sep. 22, 2011

(87) PCT Pub. No.: WO2010/109864

PCT Pub. Date: Sep. 30, 2010

(65) Prior Publication Data

US 2012/0020817 A1 Jan. 26, 2012

(30) Foreign Application Priority Data

Mar. 24, 2009 (JP) ..... 2009-072617

(51) Int. Cl.
*F04B 39/02* (2006.01)
*F04B 39/00* (2006.01)

(52) U.S. Cl.
CPC ..... *F04B 39/0094* (2013.01); *F04B 39/0246* (2013.01); *F04B 39/0253* (2013.01); *F04B 39/0261* (2013.01)

(58) Field of Classification Search
CPC ..... F04B 39/0246
USPC ..... 92/72, 140, 153; 74/595, 605; 384/326, 384/429
See application file for complete search history.

(56) References Cited

U.S. PATENT DOCUMENTS

| | | | |
|---|---|---|---|
| 2008/0080995 | A1 | 4/2008 | Inoue |
| 2009/0010788 | A1 | 1/2009 | Yamaoka et al. |

FOREIGN PATENT DOCUMENTS

| | | |
|---|---|---|
| CN | 1940292 | 4/2007 |
| CN | 101153587 | 4/2008 |
| JP | 50-006006 | 2/1975 |
| JP | 61-200476 | 12/1986 |
| JP | 61-200477 | 12/1986 |
| JP | 2002-070740 | 3/2002 |
| JP | 2007-292016 | 11/2007 |

*Primary Examiner* — F. Daniel Lopez
(74) *Attorney, Agent, or Firm* — Hamre, Schumann, Mueller & Larson, P.C.

(57) ABSTRACT

Provided is a reciprocating compressor having a structure in which friction losses between a shaft and a bearing can be reduced without impairing the ability of the bearing to support the shaft. A reciprocating compressor (100) includes a cylinder (5), a piston (4), a connecting rod (6), a shaft (1), and a bearing (2). The shaft (1) has a journal portion (28) as a portion covered by the bearing (2). The journal portion (28) has a first journal portion (7) located closer to the connecting rod (6) with respect to a midpoint M of the journal portion (28) in a direction parallel to a rotational axis and a second journal portion (8) located farther from the connecting rod (6) with respect to the midpoint M. The bearing (2) has a first sliding portion (10) for supporting the first journal portion (7) and a second sliding portion (11) for supporting the second journal portion (8). The first sliding portion (10) has a first recessed portion (29) in at least one range selected from a range of 0° to 180° and a range of 270° to 360° in a rotational direction of the shaft (1) from a reference position.

10 Claims, 20 Drawing Sheets

FIG.8

| | Shaft rotation angle θ | | | | | | | | | | | |
|---|---|---|---|---|---|---|---|---|---|---|---|---|
| | 0 | 30 | 60 | 90 | 120 | 150 | 180 | 210 | 240 | 270 | 300 | 330 |
| Connecting rod swing angle β | 0 | 8 | 14 | 17 | 14 | 8 | 0 | −8 | −14 | −17 | −14 | −8 |
| Direction of action of load | 180 | 172 | 166 | 163 | 166 | 172 | 180 | 188 | 194 | 197 | 194 | 188 |
| Direction of action of upper bearing holding force | 0 | 352 | 346 | 343 | 346 | 352 | 0 | 8 | 14 | 17 | 14 | 8 |
| Direction of action of lower bearing holding force | 180 | 172 | 166 | 163 | 166 | 172 | 180 | 188 | 194 | 197 | 194 | 188 |
| Eccentric direction of upper journal portion | 270 | 262 | 256 | 253 | 256 | 262 | 270 | 278 | 284 | 287 | 284 | 278 |
| Eccentric direction of lower journal portion | 90 | 82 | 76 | 73 | 76 | 82 | 90 | 98 | 104 | 107 | 104 | 98 |
| Range of upper sliding portion that is involved in generation of negative pressure | 270−360 | 262−352 | 256−346 | 253−343 | 256−346 | 262−352 | 270−360 | 278−360, 0−8 | 284−360, 0−14 | 287−360, 0−17 | 284−360, 0−14 | 278−360 ,0−8 |
| Range of lower sliding portion that is involved in generation of negative pressure | 90−180 | 82−172 | 76−166 | 73−163 | 76−166 | 82−172 | 90−180 | 98−188 | 104−194 | 107−197 | 104−194 | 98−188 |

Unit: degrees (°)

RECIPROCATING COMPRESSOR

TECHNICAL FIELD

The present invention relates to reciprocating compressors.

BACKGROUND ART

Reciprocating compressors are widely used in refrigerators, for example (Patent Literature 1). FIG. 12 is a longitudinal cross-sectional view of the main part of a typical reciprocating compressor. A reciprocating compressor 200 includes, as main elements, a closed casing 101, a compression mechanism 103 disposed in the closed casing 101, and a motor 105 disposed in the closed casing 101 to drive the compression mechanism 103.

The compression mechanism 103 has a cylinder 112, a piston 114, a connecting rod 118, a shaft 120, and a bearing 122. The shaft 120 has a main shaft portion 124 and an eccentric portion 125 provided on the upper part of the main shaft portion 124. The main shaft portion 124 includes a journal portion 126 located inside the bearing 122, and a portion 127 projecting downwardly below the bearing 122 and fixed to the rotor of the motor 105. The eccentric portion 125 and the piston 114 are connected by the connecting rod 118. The power of the motor 105 is transmitted to the piston 114 through the shaft 120 and the connecting rod 118. As the piston 114 reciprocates in the cylinder 112, a refrigerant is compressed.

The load of the compressed refrigerant acts on the shaft 120 in the direction of an arrow A through the connecting rod 118 and the piston 114. The journal portion 126 is long enough to support large loads. The longer the journal portion 126 is, however, the more friction losses between the shaft 120 and the bearing 122 tend to increase. Since reciprocating compressors are characterized in that they undergo significant changes in the magnitude of the load during one cycle, the longer journal portion 126 may produce opposite effects. That is, the longer journal portion 126 works effectively when a large load is applied, but the longer journal portion 126 causes an increase in friction losses when a small load is applied.

In order to solve this problem, conventionally, a reduced diameter portion 128 with a smaller diameter is formed in the main shaft portion 124. This reduced diameter portion 128 achieves reduction of friction losses between the shaft 120 and the bearing 122 without impairing the ability of the bearing 122 to support the shaft 120.

CITATION LIST

Patent Literature

Patent Literature 1 JP 2002-70740 A

SUMMARY OF INVENTION

Technical Problem

As a result of intensive studies, the present inventors have found that there is a structure in which the friction losses can further be reduced without impairing the ability to support the shaft. It is an object of the present invention to provide a technique for reducing friction losses in a reciprocating compressor.

Solution to Problem

The present invention provides a reciprocating compressor including: a cylinder; a piston reciprocably disposed in the cylinder; a connecting rod connected to the piston; a shaft having a rotational axis perpendicular to a reciprocating direction of the piston, and connected to the connecting rod so that rotational motion of the shaft itself is converted into linear motion of the piston; and a bearing for supporting the shaft. In this reciprocating compressor, the shaft has a journal portion as a portion covered by the bearing. The journal portion has a first journal portion and a second journal portion. The first journal portion is located closer to the connecting rod with respect to a midpoint of the journal portion in a direction parallel to the rotational axis, and the second journal portion is located farther from the connecting rod with respect to the midpoint. The bearing has a first sliding portion for supporting the first journal portion and a second sliding portion for supporting the second journal portion. When a plane that is parallel to the reciprocating direction of the piston and includes the rotational axis of the shaft intersects an inner circumferential surface of the bearing at two positions and the position closer to the piston is defined as a reference position, the first sliding portion has a first recessed portion in at least one range selected from a range of 0° to 180° and a range of 270° to 360° in a rotational direction of the shaft from the reference position. The first recessed portion forms a larger bearing clearance than a bearing clearance formed in a range other than the ranges.

Advantageous Effects of Invention

As described later, in the reciprocating compressor, the supporting force exerted by the bearing is not uniform in the circumferential direction. In theory, some parts of the bearing of the reciprocating compressor make a large contribution to support the shaft but other parts thereof make a small contribution. According to the present invention, the recessed portion is formed in the part that makes a small contribution. That is, the bearing clearance between the shaft and the region of the bearing that makes a small contribution to support the shaft is increased without impairing the reliability of the bearing. This can reduce friction losses, which have occurred conventionally in this part, and therefore the efficiency of the reciprocating compressor is improved.

BRIEF DESCRIPTION OF DRAWINGS

FIG. 8 is a table showing, at each rotation angle of a shaft, the swing angle of a connecting rod, the direction of action of a load, the direction of action of an upper bearing holding force, the direction of action of a lower bearing holding force, the eccentric direction of an upper journal portion, the eccentric direction of a lower journal portion, the range of an upper sliding portion that is involved in the generation of a negative pressure, and the range of a lower sliding portion that is involved in the generation of a negative pressure.

DESCRIPTION OF EMBODIMENTS

Hereinafter, embodiments of the present invention will be described with reference to the accompanying drawings.

First Embodiment

Figure 1:
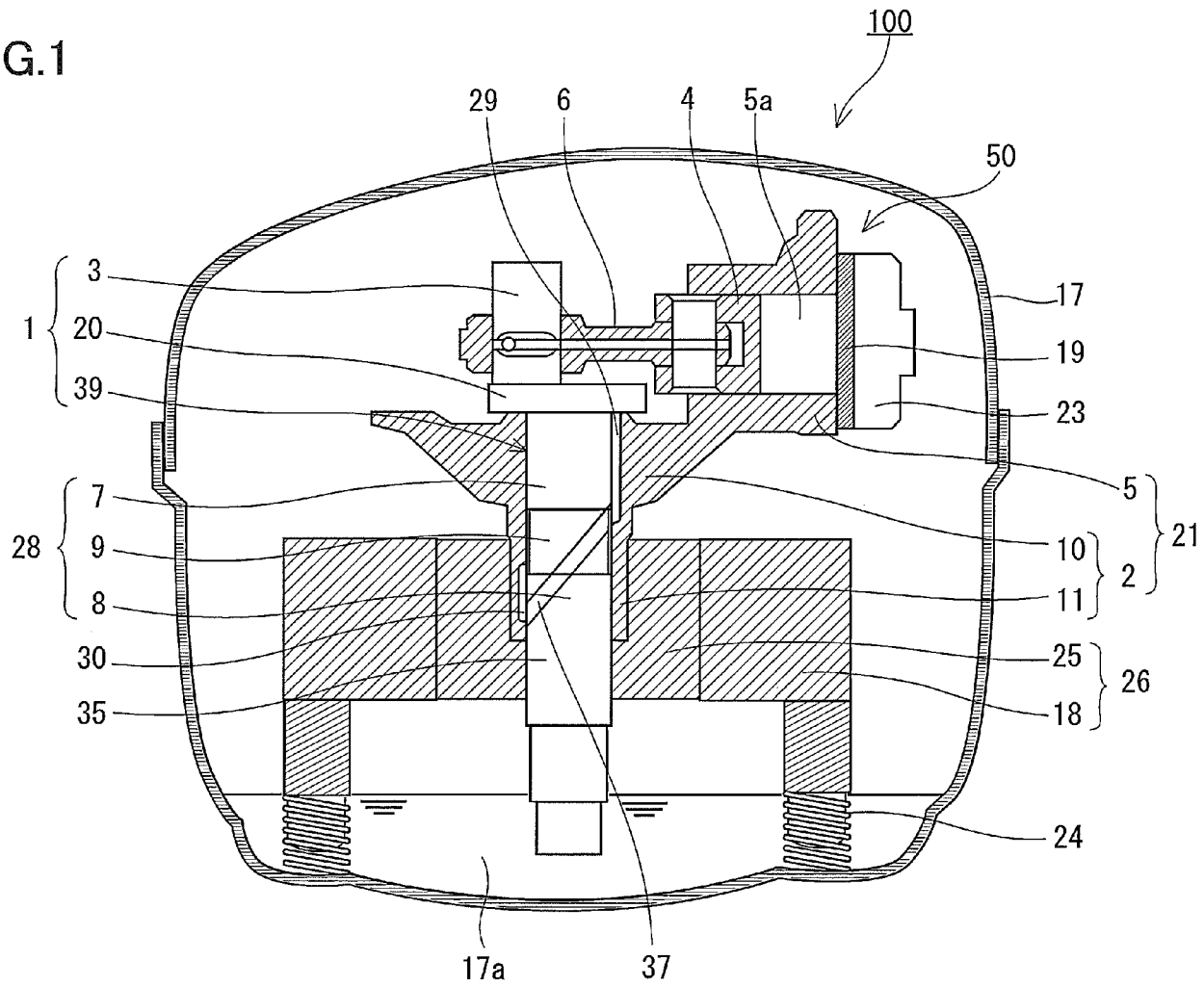
FIG. 1 is a schematic longitudinal cross-sectional view of a reciprocating compressor according to a first embodiment of the present invention.

FIG. 1 is a longitudinal cross-sectional view of a reciprocating compressor of the present embodiment. A reciprocating compressor 100 includes, as main elements, a closed casing 17, a compression mechanism 50 disposed in the closed casing 17, and a motor 26 (electric element) disposed in the closed casing 17 to drive the compression mechanism 50.

The motor 26 includes a stator 18 and a rotor 25. In the present embodiment, the rotational axis of the motor 26 is parallel to the vertical direction. The lower part of the stator 18 is fixed to the closed casing 17 by a supporting spring 24. An oil reservoir 17*a* for holding lubricating oil (refrigerating machine oil) is formed in the bottom part of the closed casing 17.

The compression mechanism 50 has a shaft 1, a bearing 2, a piston 4, a cylinder 5, and a connecting rod 6. The bearing 2 and the cylinder 5 are formed integrally as a part of a supporting frame 21. The supporting frame 21 is fixed to the closed casing 17 by a not-shown fastening member so that the rotational axis of the motor 26 coincides with the central axis of the bearing 2. The piston 4 is disposed reciprocably in the cylindrical cylinder 5. The reciprocating direction of the piston 4 is parallel to the horizontal direction. A cylinder head 23 having valves 19 (a suction valve and a discharge valve) are mounted on the end portion of the cylinder 5. A compression chamber 5*a* is formed between the piston 4 and the cylinder head 23.

The shaft 1 has a main shaft portion 39, an eccentric plate 20, and an eccentric portion 3. The main shaft portion 39 is inserted into the bearing 2. The rotational axis of the main shaft portion 39, that is, the rotational axis of the shaft 1 is perpendicular to the reciprocating direction of the piston 4 and parallel to the vertical direction. In the present description, the direction parallel to the rotational axis of the shaft 1 is referred to as an axial direction. The eccentric plate 20 is provided on the upper end of the main shaft portion 39, and the eccentric portion 3 (eccentric shaft) is provided on the upper surface of the eccentric plate 20. The eccentric portion 3 and the eccentric plate 20 are located outside the bearing 2. The center of the eccentric portion 3 is deviated from the center of the main shaft portion 39. The eccentric portion 3 and the piston 4 are connected by the connecting rod 6. The rotational motion of the motor 26 is converted into the reciprocating motion of the piston 4 by the action of the eccentric portion 3 and the connecting rod 6. The main shaft portion 39, the eccentric plate 20, and the eccentric portion 3 are usually formed integrally.

Specifically, the main shaft portion 39 has a journal portion 28, a reduced diameter portion 9, and a driven portion 35. The journal portion 28 is a portion covered by the bearing 2. The reduced diameter portion 9 is a portion for separating the journal portion 28 in the bearing 2 into an upper journal portion 7 (first journal portion) and a lower journal portion 8 (second journal portion). The upper journal portion 7 is located closer to the connecting rod 6 than the lower journal portion 8. The upper journal portion 7 and the lower journal portion 8 may have the same length or different lengths in the axial direction. The outer diameter of the reduced diameter portion 9 is smaller than that of the journal portion 28. The difference between the outer diameter of the journal portion 28 and that of the reduced diameter portion 9 is 100 to 300 μm, for example. The reduced diameter portion 9 can reduce friction losses between the shaft 1 and the bearing 2.

The driven portion 35 is a portion projecting downwardly below the bearing 2 and fixed to the rotor 25 of the motor 26. A not-shown speed-type oil pump (centrifugal pump) is formed inside the driven portion 35. The lower end of the driven portion 35 extends into the oil reservoir 17*a* and is in contact with lubricating oil. As the shaft 1 rotates, the lubricating oil is drawn from the lower end of the driven portion 35 into the speed-type oil pump. Then, the oil is supplied to the parts that require lubrication and/or sealing through an oil supply groove 37 formed on the outer circumferential surface of the main shaft portion 39. The parts that require lubrication and/or sealing are, for example, the clearance between the journal portion 28 and the bearing 2, the clearance between the lower surface of the eccentric plate 20 and the open end surface of the bearing 2, the joint between the eccentric portion 3 and the connecting rod 6, and the clearance between the piston 4 and the cylinder 5.

The bearing 2 has an upper sliding portion 10 (first sliding portion) for supporting the upper journal portion 7 and a lower sliding portion 11 (second sliding portion) for supporting the lower journal portion 8. The upper sliding portion 10 covers the upper journal portion 7, and the lower sliding portion 11 covers the lower journal portion 8. The central axis of the bearing 2 coincides with the rotational axis of the shaft 1.

An upper recessed portion 29 (first recessed portion) is formed in a range of the upper sliding portion 10 and forms a larger bearing clearance than a bearing clearance formed in a range other than the range. Likewise, a lower recessed portion 30 (second recessed portion) is formed in a range of the lower sliding portion 11 and forms a larger bearing clearance than a bearing clearance formed in a range other than the range. With the upper recessed portion 29 and the lower recessed portion 30, the friction losses between the shaft 1 and the bearing 2 can be reduced without impairing the ability required for the bearing 2 to support the shaft 1. Generally, the width (dimension) of a bearing clearance is a value defined by the difference between the inner diameter of a bearing and the diameter of a shaft. In the present description, however, since the recessed portions 29 and 30 are formed in the bearing 2, the inner diameter of the bearing is not constant. Therefore, the width of the bearing clearance can be defined as follows. That is, a value derived from the difference between the radius of the shaft 1 and the distance from the central axis of the bearing 2 to the inner circumferential surface of the bearing 2 at an arbitrary angular position on the circumference of the shaft 1 can be defined as the width of the bearing clearance at that angular position.

The effect of reducing friction losses can also be obtained in the case where only either one of the upper recessed portion 29 and the lower recessed portion 30 is provided. As is clear from the description below, however, the supporting force exerted by the upper sliding portion 10 is greater than the supporting force exerted by the lower sliding portion 11. Therefore, the effect produced by the upper recessed portion 29 is greater than the effect produced by the lower recessed portion 30.

When electric power is supplied to the motor 26, the shaft 1 fixed to the rotor 25 rotates. When the shaft 1 rotates, the piston 4 connected to the eccentric portion 3 by the connecting rod 6 reciprocates inside the cylinder 5. A working fluid (typically a refrigerant) is drawn into the compression chamber 5*a* and compressed according to the reciprocating motion of the piston 4. As mentioned above, the reciprocating compressor 100 of the present embodiment is configured as a single cylinder type reciprocating compressor. The axial direction of the shaft 1 may be parallel to the horizontal direction and the reciprocating direction of the piston 4 may be parallel to the vertical direction. Also in the case where the axial direction of the shaft 1 is parallel to the horizontal direction, the side on which the connecting rod 6 is located is defined as the upper side of the axial direction and the opposite side is defined as the lower side of the axial direction, for convenience.

Next, the upper recessed portion 29 and the lower recessed portion 30 are described in detail.

Figure 2:
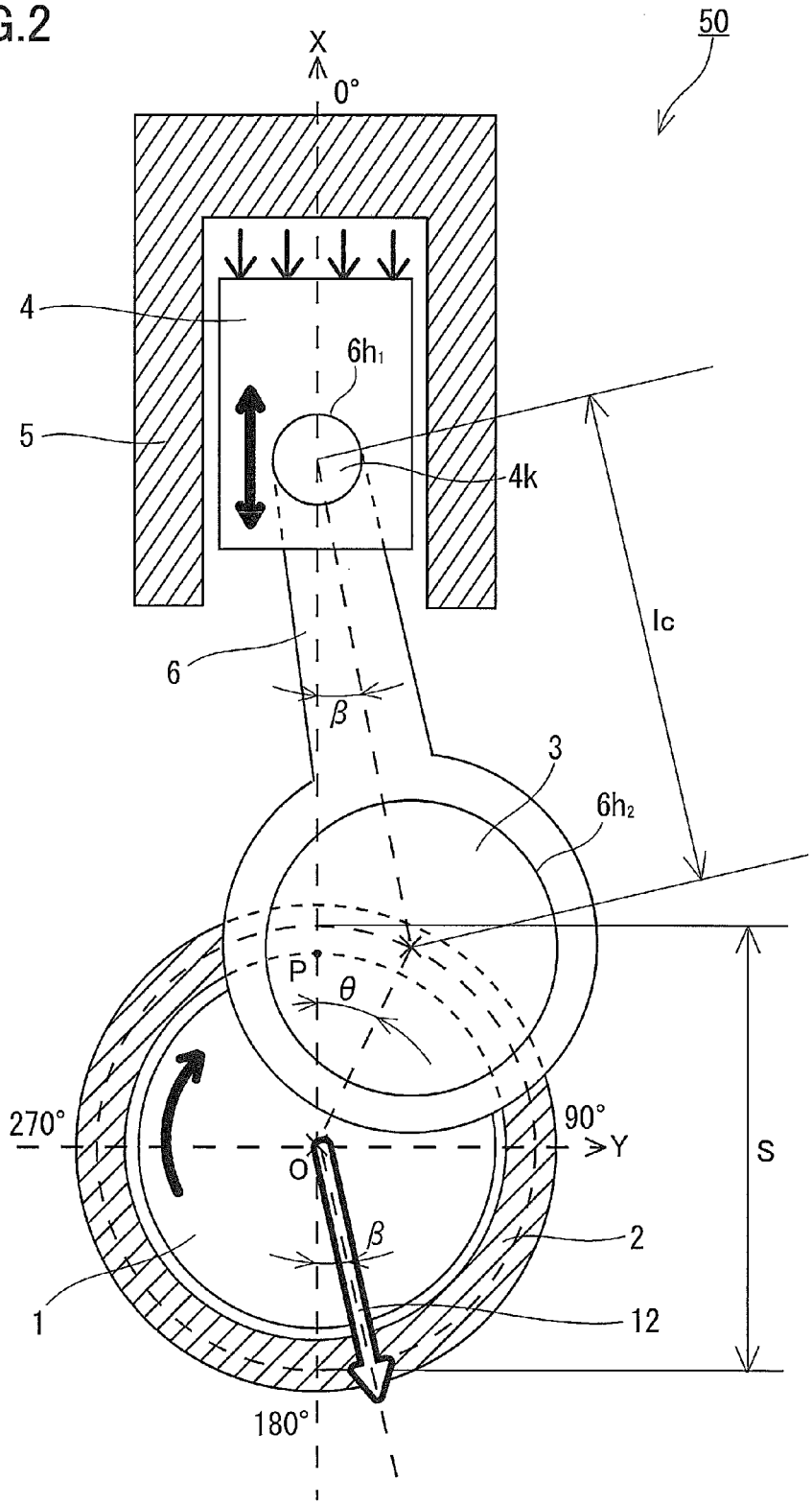
FIG. 2 is a schematic diagram showing the direction of action of a load generated by a compressed refrigerant.

First, as shown in FIG. 2, an XY coordinate system is defined in the compression mechanism 50. Specifically, the origin O is placed on the rotational axis of the shaft 1. The axis that is parallel to the reciprocating direction of the piston 4 and passes through the origin O is defined as the X axis. The axis that is perpendicular to the X axis and the rotational axis of the shaft 1 and passes through the origin O is defined as the Y axis. This XY coordinate system corresponds to the top plan view of the compression mechanism 50. The plane that is parallel to the reciprocating direction of the piston 4 (X direction) and includes the rotational axis of the shaft 1 intersects the inner circumferential surface of the bearing 2 at two positions. Among these two positions, the position closer to the piston 4 is defined as a reference position P. The rotation angle θ of the shaft 1 at which the piston 4 is located at the top dead center is defined as 0°. Furthermore, in FIG. 2, the clockwise direction is defined as the rotational direction of the shaft 1, that is, a positive rotational direction.

The connecting rod 6 has a swing angle depending on the phase of the shaft 1 and the design values of the respective members. This angle is referred to as a connecting rod swing angle β. The connecting rod swing angle β is represented by Equation (1), where lc is the length of the connecting rod 6, S is the stroke of the piston 4, and θ is the rotation angle of the shaft 1. The length lc of the connecting rod 6 corresponds to the length of a line segment connecting the center of the eccentric portion 3 of the shaft 1 and the center of a piston pin 4*k*. In other words, the length lc of the connecting rod 6 is represented by the length of a line segment connecting the center of a connecting hole 6*h*1 provided on one end of the connecting rod 6 and the center of a connecting hole 6*h*2 provided on the other end thereof. The "connecting rod swing angle" is an angle formed by that line segment having the length lc and the X axis.

[Equation 1]

$$\beta = \sin^{-1}\left\{\frac{S}{2lc}\sin\theta\right\} \tag{1}$$

Next, a load that occurs during the operation of the reciprocating compressor 100 is described. During the operation of the reciprocating compressor 100, a load of a compressed refrigerant acts on the piston 4 in the −X direction (direction of 180°) in the coordinate system of FIG. 2. This load is transferred to the shaft 1 through the piston 4 and the connecting rod 6. To determine exactly the direction of action of the load 12 applied on the shaft 1, the connecting rod swing angle β must be considered. That is, the direction of action of the load 12 is the direction of (180−β)°, to be exact. For example, if the angle β varies in the range of −17° to 17° during one rotation of the shaft 1, the direction of action of the load 12 varies in the range of 163° to 197°.

Figure 3:
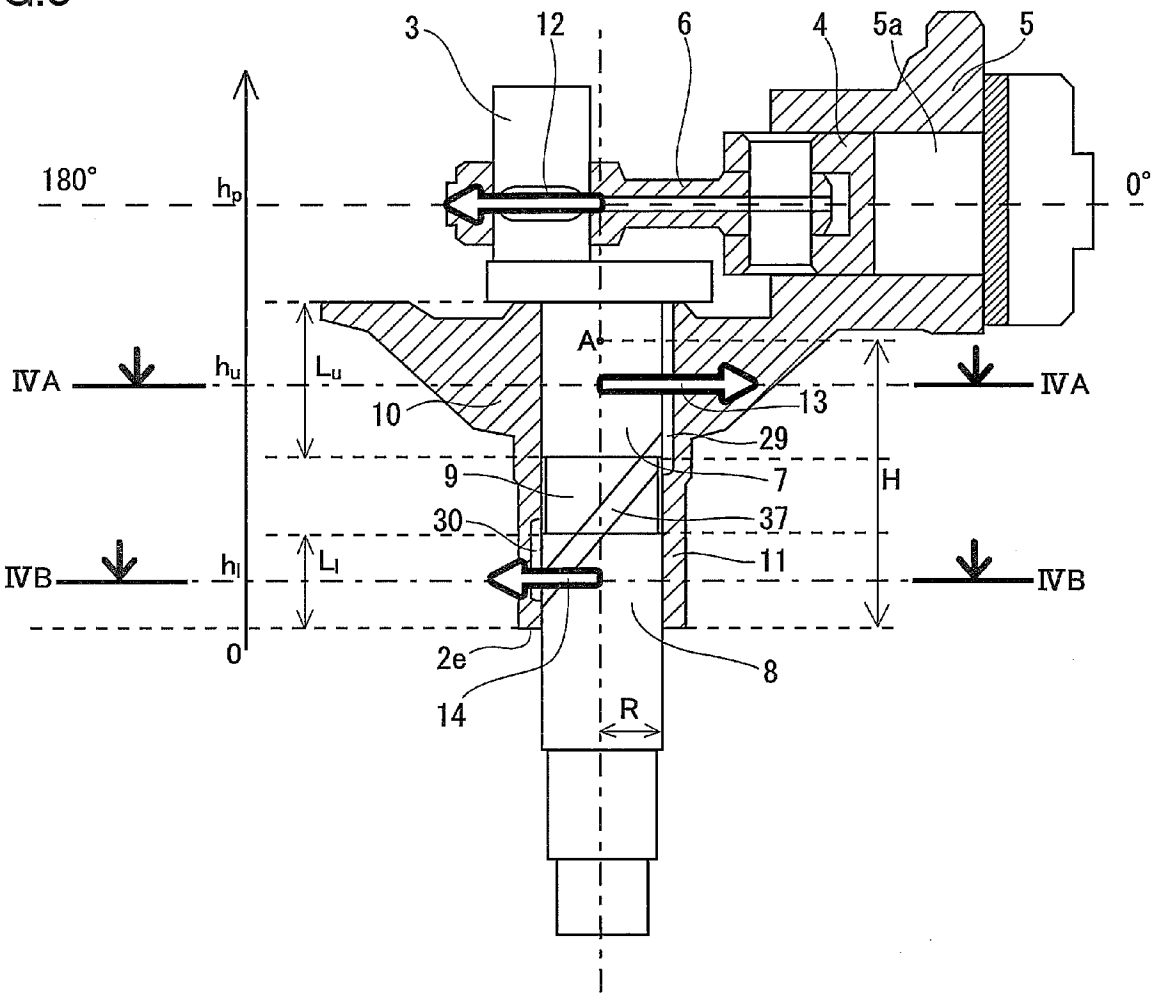
FIG. 3 is a schematic diagram showing the direction of action of a load generated by a compressed refrigerant, and the directions of action of bearing holding forces.

As shown in FIG. 3, the load 12 is supported by the bearing holding forces generated by the lubricating oil filled in the clearances (bearing clearances) between the shaft 1 and the bearing 2. In detail, an upper bearing holding force 13 is generated by the lubricating oil filled in the clearance between the upper journal portion 7 and the upper sliding portion 10, and a lower bearing holding force 14 is generated by the lubricating oil filled in the clearance between the lower journal portion 8 and the lower sliding portion 11. The directions of action of the upper and lower bearing holding forces 13 and 14 can be explained as follows, based on the balance of forces and the balance of moments in the shaft 1.

First, a coordinate system shown in FIG. 3 is defined to indicate positions in the axial direction. The lower end 2*e* of the bearing 2 is defined as a reference position in the axial direction, and the direction from the reference position toward the eccentric portion 3 is defined as a positive direction.

When the capacity of the compression chamber 5*a* is small, the maximum load 12 acts on the shaft 1. Specifically, the load 12 is maximum when the rotation angle θ of the shaft 1 is about 0° (360°) and the piston 4 is located near the top dead center. When the rotation angle θ of the shaft 1 is about 0°, the connecting rod swing angle β is about 0° according to Equation (1). That is, the maximum load 12 acts on the shaft 1 in the direction of 180°. The load 12 decreases rapidly with increasing or decreasing rotation angle θ of the shaft 1 from 0°. Therefore, the direction of action of the load 12 can be regarded as being fixed at 180°. Hereinafter in this embodiment, it is assumed that the load 12 acts on the shaft 1 only in the direction of 180°, without regard to the connecting rod swing angle β.

As shown in FIG. 3, the point of action of the load 12 in the axial direction is the midpoint $h_p$ of the piston 4 in the axial direction. The point of action of the upper bearing holding force 13 in the axial direction is the midpoint $h_u$ of the upper journal portion 7 in the axial direction. The point of action of the lower bearing holding force 14 in the axial direction is the midpoint $h_l$ of the lower journal portion 8 in the axial direction.

Here, the load 12, the upper bearing holding force 13, and the lower bearing holding force 14 are denoted as F, $P_u$, and $P_l$. The length of the upper journal portion 7 in the axial direction is denoted as $L_u$, and the length of the lower journal portion 8 in the axial direction is denoted as $L_l$. The radii of the upper journal portion 7 and the lower journal portion 8 are each denoted as R. The point at an arbitrary height H on the rotational axis of the shaft 1 (where $h_p$>H) is denoted as A, and the distance from the point A to the point of action $h_p$ of the load 12 is denoted as $l_r$ (=$h_p$−H). The distance from the point A to the point of action $h_u$ of the upper bearing holding force 13 is denoted as $l_u$ (=$h_u$−H), and the distance from the point A to the point of action $h_l$ of the lower bearing holding force 14 is denoted as $l_l$ (=$h_l$−H). The balance of forces in the shaft 1 is represented by Equation (2). In Equation (2), the direction of action of the load 12 is a positive direction of action.

[Equation 2]

$$F+2P_uL_uR+2P_lL_lR=0 \tag{2}$$

The balance of moments at the point A is represented by Equation (3). In Equation (3), when the upper end of the shaft 1 rotates in a direction opposite to the direction of action of the load 12, that opposite direction is a positive moment direction. Equation (4) is derived from Equation (2) and Equation (3). Equation (5) is derived from Equation (2) and Equation (4).

[Equation 3]

$$-Fl_r-(2P_uL_uR)l_u-(2P_lL_lR)l_l=0 \tag{3}$$

[Equation 4]

$$P_u(l_r-l_u)L_u+P_l(l_r-l_l)L_l=0 \tag{4}$$

[Equation 5]

$$F+\frac{l_l-l_u}{l_r-l_u}2P_lL_lR=0 \tag{5}$$

Since $l_r$=$h_p$−H, $l_u$=$h_u$−H, and $l_l$=$h_l$−H hold, ($l_r$−$l_u$)>0, ($l_r$−$l_l$)>0, and ($l_l$−$l_u$)<0 hold wherever the point A is placed on the rotational axis of the shaft 1. Therefore, when F>0 holds, $P_l$>0 holds according to Equation (5). When $P_l$>0 holds, $P_u$<0 holds according to Equation (4). That is, the upper bearing holding force 13 acts in the opposite direction to the load 12, and the lower bearing holding force 14 acts in the same direction as the load 12.

In FIG. 3, the load 12, the upper bearing holding force 13, and the lower bearing holding force 14 are shown in the directions of 180°, 0°, and 180°, respectively. Since the upper bearing holding force 13 and the lower bearing holding force 14 act in these directions, the upper journal portion 7 becomes eccentric in the direction of 270° and the lower journal portion 8 becomes eccentric in the direction of 90°, based on the relationship between the eccentric direction of the shaft 1 and the directions of action of the bearing holding forces. That is, the upper bearing holding force 13 and the lower bearing holding force 14 act in the directions shown in FIG. 3 as long as the shaft 1 rotates while maintaining the balance of the forces and the balance of the moments. Accordingly, the eccentric directions of the upper journal portion 7 and the lower journal portion 8 are uniquely determined so that the upper bearing holding force 13 and the lower bearing holding force 14 act in the above directions. The eccentric directions of the journal portions and the directions of action of the bearing holding forces are described below in detail.

Figure 4A:
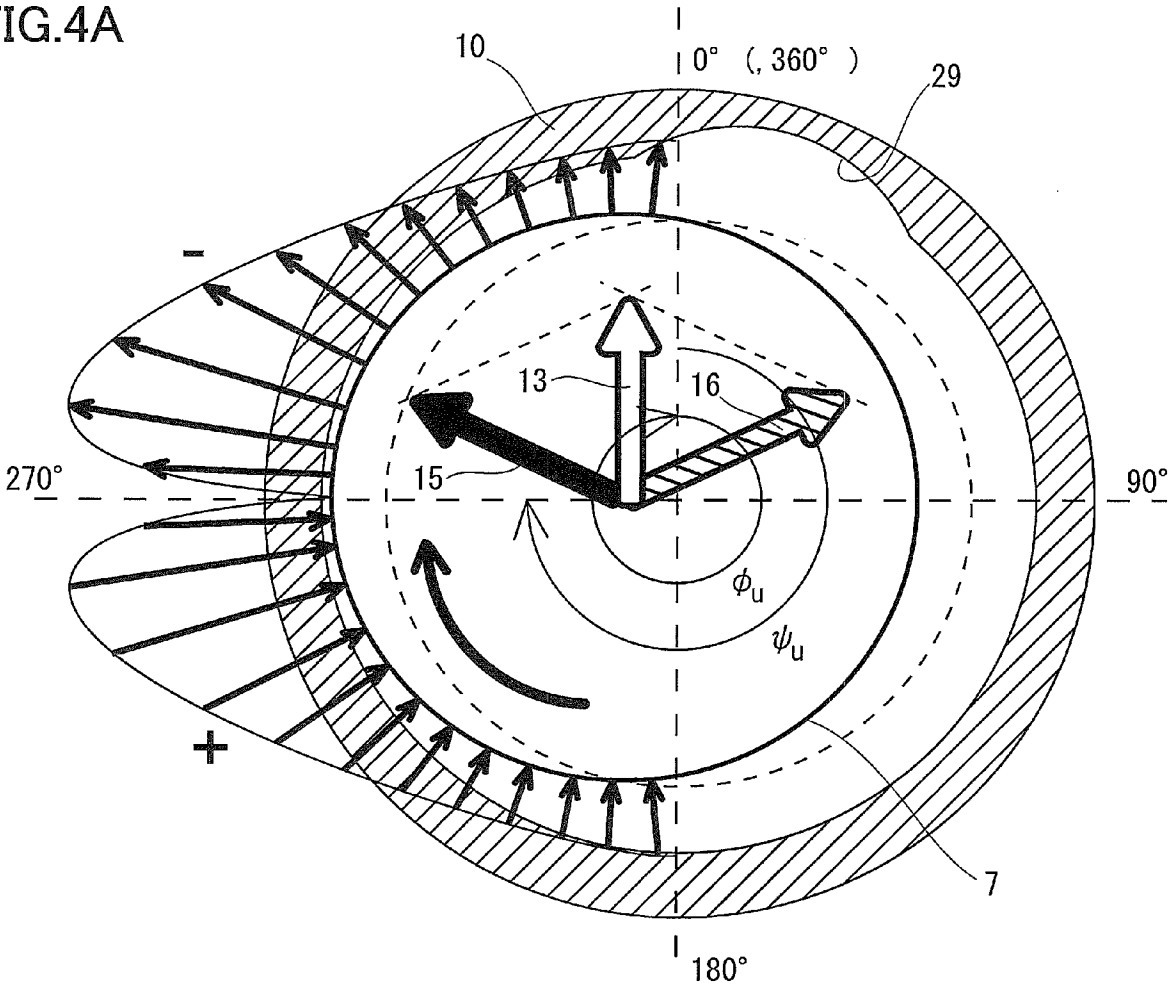
FIG. 4A is a transverse cross-sectional view of an upper journal portion and an upper sliding portion, taken along the line IVA-IVA.

FIG. 4A is an enlarged transverse cross-sectional view of the upper journal portion and the upper sliding portion, taken along the line IVA-IVA. FIG. 4A shows the eccentric direction of the upper journal portion 7 and the direction of action of the upper bearing holding force 13. The upper journal portion 7 is eccentric in the direction of 270°. Therefore, in the range of more than 180° and less than 270°, the lubricating oil between the upper journal portion 7 and the upper sliding portion 10 is drawn in a direction in which the clearance between the upper journal portion 7 and the upper sliding portion 10 is reduced. As a result, the lubricating oil filled in the range of more than 180° and less than 270° has a higher pressure than that filled in the other range, and generates a positive pressure 16 in a direction in which the upper journal portion 7 is pushed away from the upper sliding portion 10. The positive pressure 16 acts in a direction that is slightly inclined in the opposite direction to the rotational direction of the shaft 1, with respect to the counter-eccentric direction (direction of 90°).

Conversely, in the range of 270° to 360°, the lubricating oil is discharged in a direction in which the clearance is increased. As a result, the lubricating oil filled in the range of 270° to 360° has a lower pressure than that filled in the other range, and generates a negative pressure 15 in a direction in which the upper journal portion 7 is drawn toward the upper sliding portion 10. The negative pressure 15 acts in a direction that is slightly inclined in the rotational direction of the shaft 1, with respect to the eccentric direction (direction of 270°). The resultant force of the positive pressure 16 and the negative pressure 15 is the upper bearing holding force 13 in the upper journal portion 7. As described above, when the upper journal portion 7 is eccentric in the direction of 270°, the upper bearing holding force 13 acts in the direction of 0°. Conversely, in order to allow the upper bearing holding force 13 to act in the opposite direction to the load 12 (see FIG. 3), the upper journal portion 7 inevitably becomes eccentric in the direction of 270°.

Figure 4B:
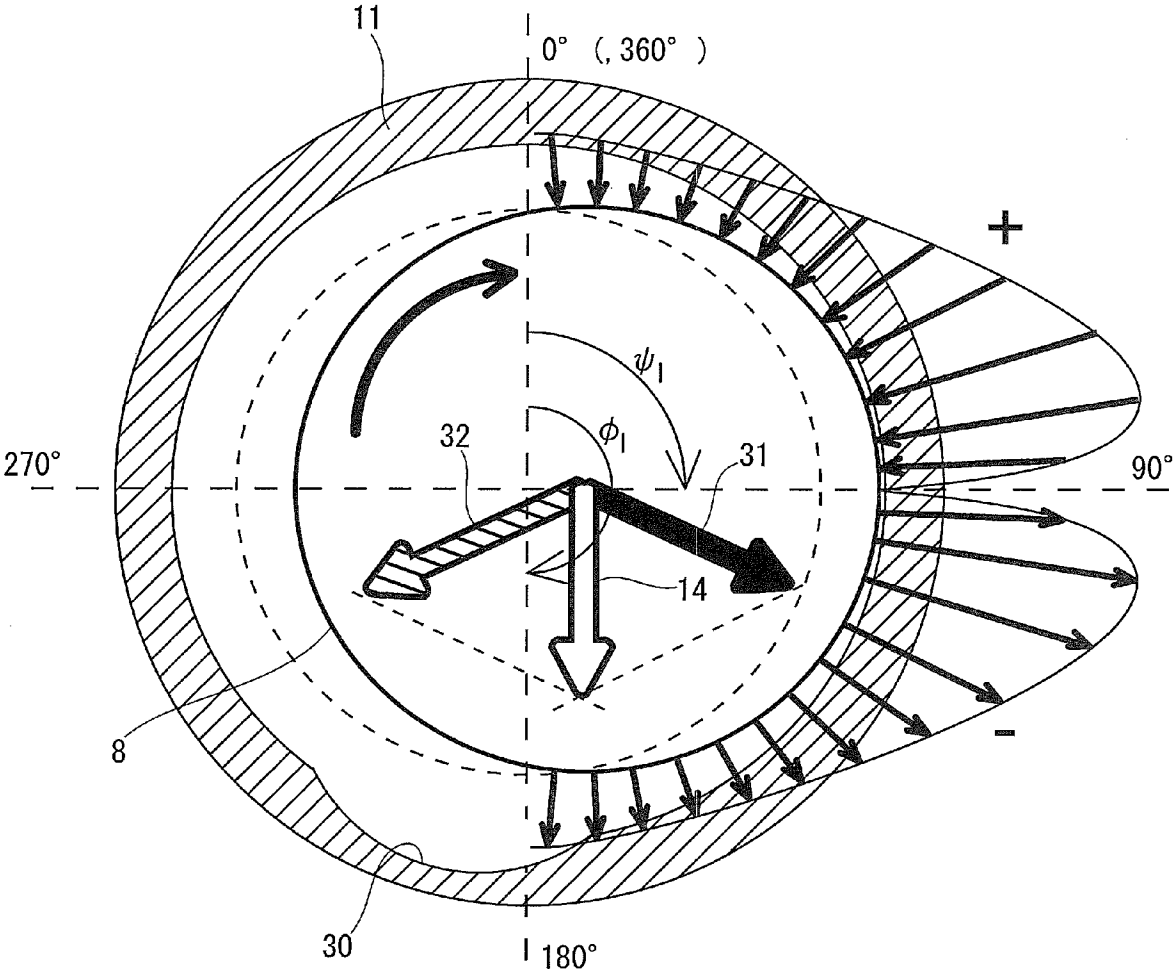
FIG. 4B is a transverse cross-sectional view of a lower journal portion and a lower sliding portion, taken along the line IVB-IVB.

FIG. 4B is an enlarged transverse cross-sectional view of the lower journal portion and the lower sliding portion, taken along the line IVB-IVB. FIG. 4B shows the eccentric direction of the lower journal portion 8 and the direction of action of the lower bearing holding force 14. The lower journal portion 8 is eccentric in the direction of 90°. Therefore, in the range of more than 0° and less than 90°, the lubricating oil between the lower journal portion 8 and the lower sliding portion 11 is drawn in a direction in which the clearance between the lower journal portion 8 and the lower sliding portion 11 is reduced. As a result, the lubricating oil filled in the range of more than 0° and less than 90° has a higher pressure than that filled in the other range, and generates a positive pressure 32 in a direction in which the lower journal portion 8 is pushed away from the lower sliding portion 11. The positive pressure 32 acts in a direction that is slightly inclined in the opposite direction to the rotational direction of the shaft 1, with respect to the counter-eccentric direction (direction of 270°).

Conversely, in the range of 90° to 180°, the lubricating oil is discharged in a direction in which the clearance is increased. As a result, the lubricating oil filled in the range of 90° to 180° has a lower pressure than that filled in the other range, and generates a negative pressure 31 in a direction in which the lower journal portion 8 is drawn toward the lower sliding portion 11. The negative pressure 31 acts in a direction that is slightly inclined in the rotational direction of the shaft 1, with respect to the eccentric direction (direction of 90°). The resultant force of the positive pressure 32 and the negative pressure 31 is the lower bearing holding force 14 in the lower journal portion 8. As described above, when the lower journal portion 8 is eccentric in the direction of 90°, the lower bearing holding force 14 acts in the direction of 180°. Conversely, in order to allow the lower bearing holding force 14 to act in the same direction as the load 12 (see FIG. 3), the lower journal portion 8 inevitably becomes eccentric in the direction of 90°.

The shaft 1, which is in a posture with the upper journal portion 7 being inclined in the direction of 270° and the lower journal portion 8 being inclined in the direction of 90°, rotates while being supported by the upper bearing holding force 13 acting in the direction of 0° and the lower bearing holding force 14 acting in the direction of 180°. This theory is also described in Yamamoto, Yuji and Kaneta, Sadahiro, "Tribology", Rikogakusha Publishing Co., Ltd. 1998, p. 84.

Since the positive pressure 16 acts in the direction in which the clearance between the upper journal portion 7 and the upper sliding portion 10 is increased, it is a force for supporting the shaft 1. Likewise, since the positive pressure 32 acts in the direction in which the clearance between the lower journal portion 8 and the lower sliding portion 11 is increased, it also is a force for supporting the shaft 1. On the other hand, since the negative pressure 15 acts in the direction in which the clearance between the upper journal portion 7 and the upper sliding portion 10 is reduced, it is a force for preventing the support of the shaft 1. Likewise, since the negative pressure 31 acts in the direction in which the clearance between the lower journal portion 8 and the lower sliding portion 11 is reduced, it also is a force for preventing the support of the shaft 1.

As understood from the above description, the upper sliding portion 10 in the ranges of 270° to 360° and 0° to 180° is not involved in the generation of the positive pressure 16 in theory, and makes a very small contribution to support the upper journal portion 7. Therefore, if the upper recessed portion 29 is formed in at least one range selected from the range of 0° to 180° and the range of 270° to 360° in the rotational direction of the shaft 1 from the reference position, the friction loss between the upper journal portion 7 and the upper sliding portion 10 can be reduced without impairing the ability required for the upper sliding portion 10 to support the shaft 1.

The lower sliding portion 11 in the range of 90° to 360° is not involved in the generation of the positive pressure 32 in theory, and makes a very small contribution to support the lower journal portion 8. Therefore, if the lower recessed portion 30 is formed in the range of 90° to 360° in the rotational direction of the shaft 1 from the reference position, the friction loss between the lower journal portion 8 and the lower sliding portion 11 can be reduced without impairing the ability required for the lower sliding portion 11 to support the shaft 1.

The specific structure of the upper recessed portion 29 and the lower recessed portion 30 are further described. To facilitate understanding, a developed view of the bearing 2 is shown in FIG. 5A.

As described above, in theory, the upper recessed portion 29 may be formed over the entire range of 0° to 180° and the entire range of 270° to 360° in the rotational direction of the shaft 1 from the reference position (0°). However, in view of the reliability of the bearing 2, it is preferable to form the upper recessed portion 29 only in a part of these ranges. As shown in FIG. 5A, the dimension $\alpha_1$ of the upper recessed portion 29 in the circumferential direction is adjusted to 20° to 40°, for example, in terms of the rotation angle of the shaft 1. Likewise, the dimension $\alpha_2$ of the lower recessed portion 30 in the circumferential direction is adjusted to 20° to 40°, for example, in terms of the rotation angle of the shaft 1. The dimensions $\alpha_1$ and $\alpha_2$ each can be adjusted so that the relations $\pi D/9 \leq \alpha_1 \leq 2\pi D/9$ and $\pi D/9 \leq \alpha_2 \leq 2\pi D/9$ are satisfied, where D is the radius of the inner circumference of the bearing 2 in the region where the recessed portions 29 and 30 are not formed. These adjustments allow the shaft 1 to start rotating smoothly after the stopped state, and to stop rotating smoothly after the rotating state. These adjustments prevent the shaft 1 from being damaged or prevent unusual noises from being generated. As shown in FIG. 5A, in a developed plan view of the bearing 2, the upper recessed portion 29 and the lower recessed portion 30 have a strip shape, for example.

Figure 5A:
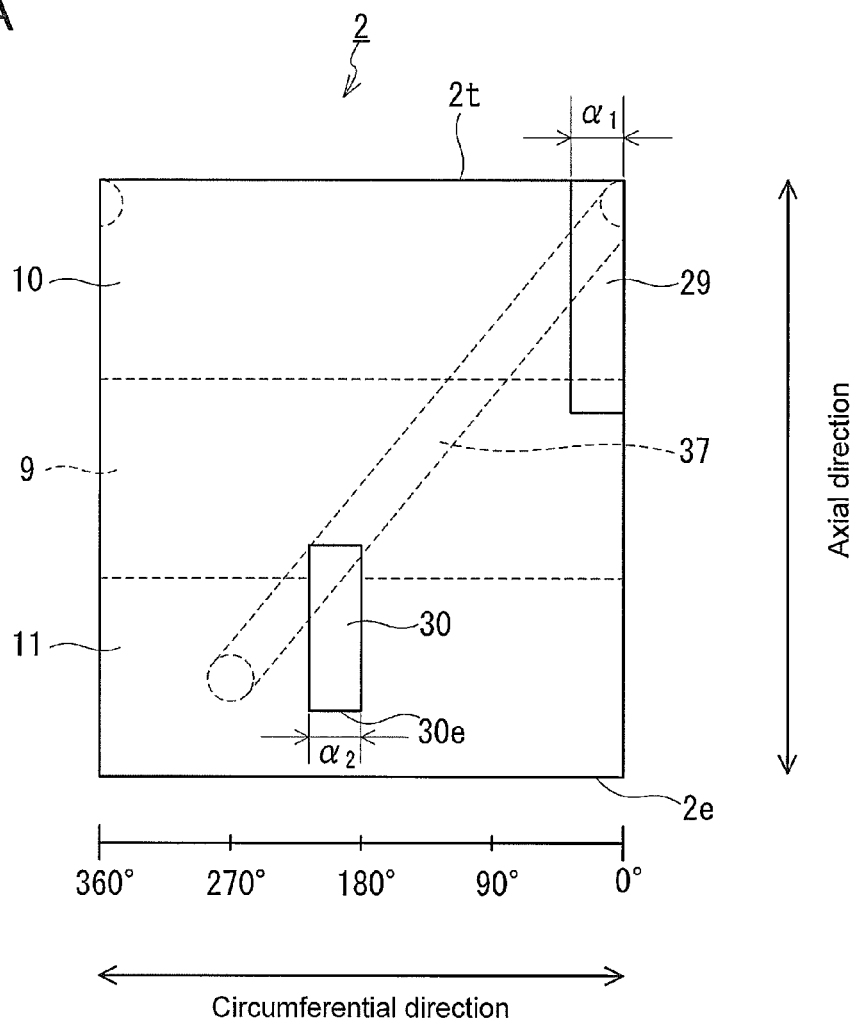
FIG. 5A is a developed view of a bearing.

As shown in FIGS. 1, 3, and 5A, in the case where the reduced diameter portion 9 is formed in the shaft 1, the upper recessed portion 29 and the lower recessed portion 30 each partially overlap the reduced diameter portion 9 in the axial direction of the shaft 1. With this configuration, the areas of the upper recessed portion 29 and the lower recessed portion 30 can be increased by extending these portions in the axial direction, which is advantageous from the viewpoint of reducing friction losses.

As shown in FIGS. 1, 3, and 5A, the lower end 30*e* of the lower recessed portion 30 is located above the lower end 2*e* of the bearing 2 in the axial direction of the shaft 1. This location prevents the lubricating oil from leaking from the bearing 2 through the lower recessed portion 30.

On the other hand, the upper recessed portion 29 extends to reach the upper end 2*t* of the bearing 2 and is closed by the lower surface of the eccentric plate 20. With this configuration, the lubricating oil is supplied between the lower surface of the eccentric plate 20 and the open end surface of the bearing 2 through the upper recessed portion 29. In the present embodiment, the open end surface of the bearing 2 supports the thrust load of the shaft 1. Using the upper recessed portion 29 as one of the oil supply passages, the lubricating oil can be supplied efficiently between the lower surface of the eccentric plate 20 and the open end surface of the bearing 2. Furthermore, it is easy to form the upper recessed portion 29 if it extends to reach the upper end 2*t* of the bearing 2, and such an upper recessed portion 29 is advantageous in increasing its area and reducing friction losses.

Figure 5B:
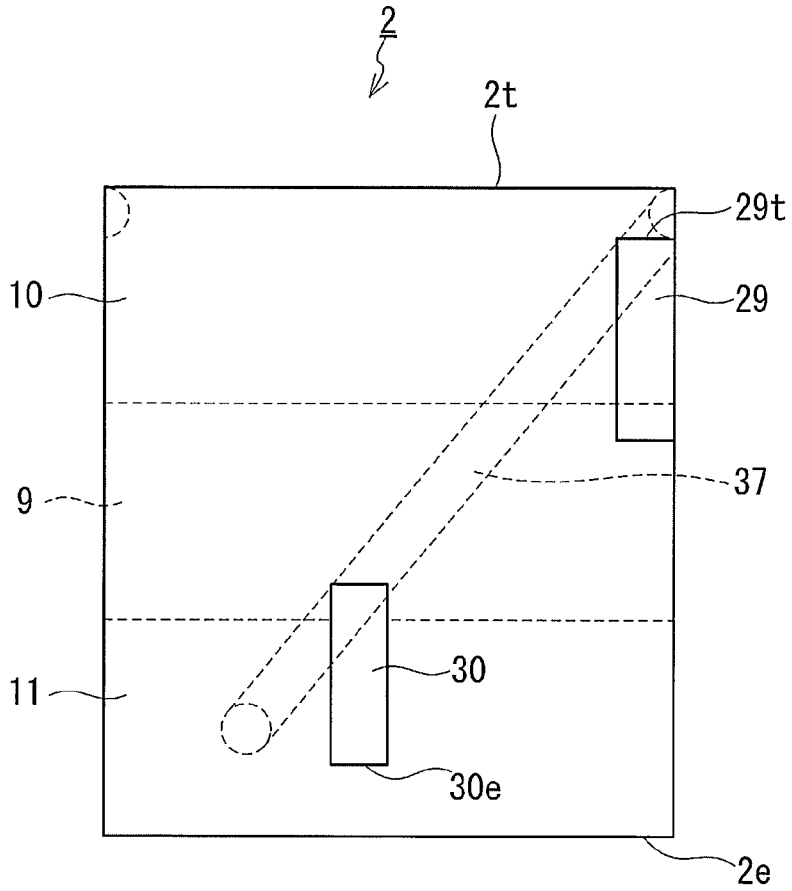
FIG. 5B is a developed view of a bearing according to a modification.

As shown in FIG. 5B, the upper end 29*t* of the upper recessed portion 29 may be located below the upper end 2*t* of the bearing 2. Particularly in the case where a ball bearing is provided in the opening of the bearing 2 to support the thrust load of the shaft 1, the upper recessed portion 29 not reaching the upper end 2*t* of the bearing 2 is more advantageous from the viewpoint of preventing the entry of gas into the bearing 2. In the case where the upper recessed portion 29 does not reach the upper end 2*t* of the bearing 2, a part having a constant inner diameter is formed in the upper sliding portion 10 entirely in the circumferential direction thereof. This configuration may be advantageous from the viewpoint of preventing the shaft 1 from being damaged by the edge of the upper recessed portion 29.

As shown in FIG. 4A, the upper recessed portion 29 has an arcuate surface profile in a cross section perpendicular to the rotational axis of the shaft 1. As shown in FIG. 4B, the lower recessed portion 30 also has an arcuate surface profile in a cross section perpendicular to the rotational axis of the shaft 1. This configuration prevents the shaft 1 from being damaged by the edges of the upper recessed portion 29 and the lower recessed portion 30. Furthermore, the upper recessed portion 29 and the lower recessed portion 30 having such a shape can be easily formed with a tool such as an end mill.

Figure 6A:
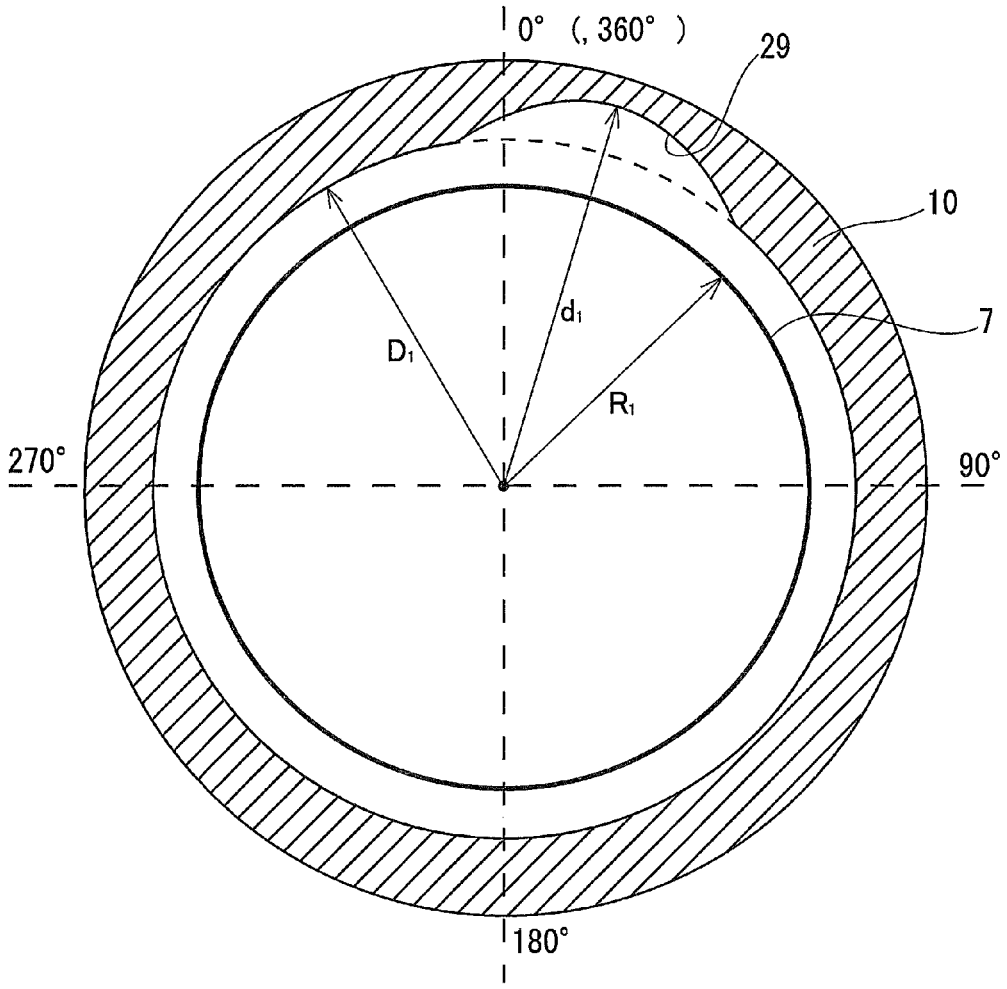
FIG. 6A is a transverse cross-sectional view showing the depth of an upper recessed portion.

The depth of the upper recessed portion 29 is not particularly limited. It can be adjusted as appropriate so as to reduce friction losses sufficiently. For example, as shown in FIG. 6A, the upper recessed portion 29 can be formed so that the relation $D_1-R_1 \leq d_1-D_1$ is satisfied, where $R_1$ is the radius of the upper journal portion 7, $D_1$ is the radius of the inner circumference of the upper sliding portion 10 in the region where the upper recessed portion 29 is not formed, and $d_1$ is the distance from the rotational axis of the shaft 1 to the deepest part of the upper recessed portion 29. The "radius of the inner circumference of the upper sliding portion 10" means the distance from the central axis of the bearing 2 to the inner circumferential surface of the upper sliding portion 10 in the region where the upper recessed portion 29 is not formed. The value $(d_1-D_1)$ represents the depth of the upper recessed portion 29 in the radial direction of the shaft 1. The value $(D_1-R_1)$ represents half the width of the clearance (bearing clearance) between the upper journal portion 7 and the upper sliding portion 10 in the region where the upper recessed portion 29 is not formed. The upper limit of the depth of the upper recessed portion 29 is not particularly limited. It is $d_1-D_1 \leq 1.5$ mm, for example. In view of the workability of the upper recessed portion 29 and its effect of reducing friction losses, the upper recessed portion 29 having a depth of several hundred micrometers (for example, 200 μm) suffices.

Figure 6B:
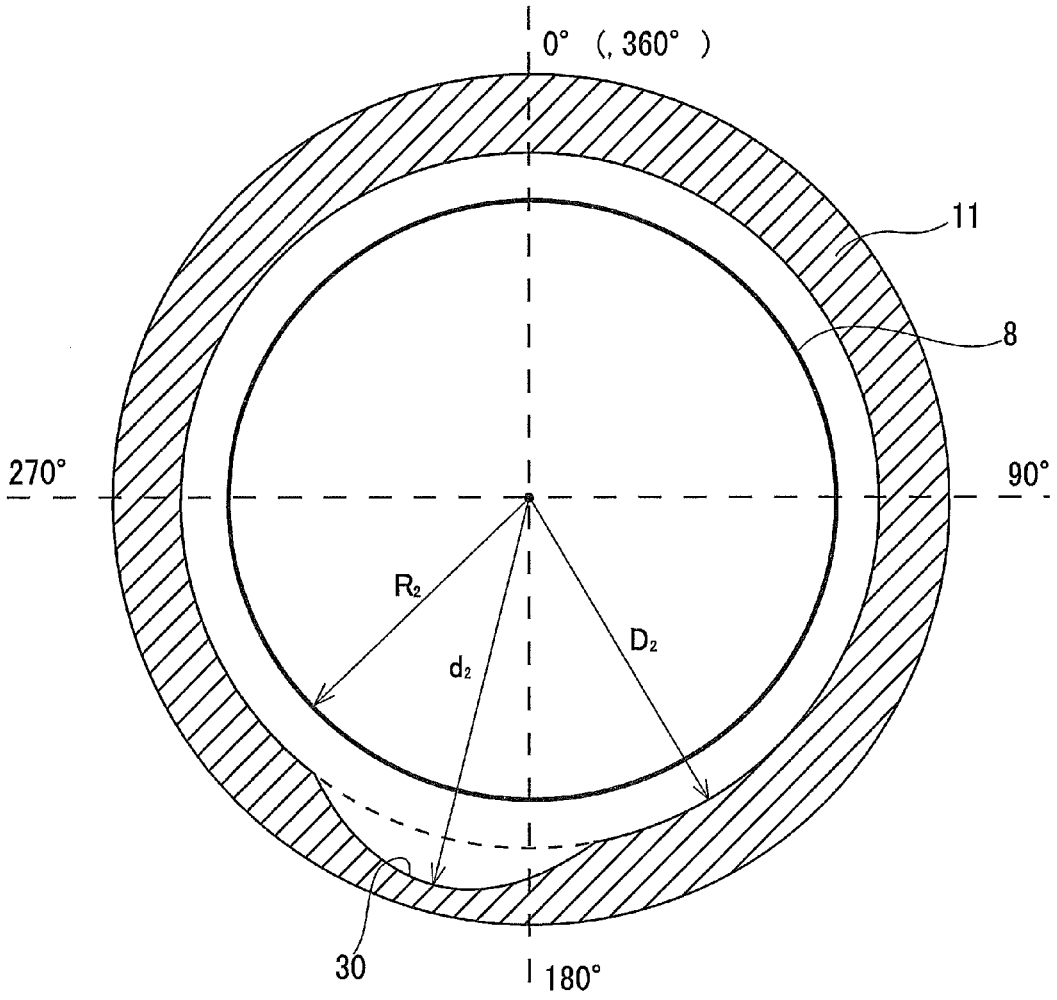
FIG. 6B is a transverse cross-sectional view showing the depth of a lower recessed portion.

Likewise, the depth of the lower recessed portion 30 is not particularly limited. It can be adjusted as appropriate so as to reduce friction losses sufficiently. For example, as shown in FIG. 6B, the lower recessed portion 30 can be formed so that the relation $D_2-R_2 \leq d_2-D_2$ is satisfied, where $R_2$ is the radius of the lower journal portion 8, $D_2$ is the radius of the inner circumference of the lower sliding portion 11 in the region where the lower recessed portion 30 is not formed, and $d_2$ is the distance from the rotational axis of the shaft 1 to the deepest part of the lower recessed portion 30. The "radius of the inner circumference of the lower sliding portion 11" means the distance from the central axis of the bearing 2 to the inner circumferential surface of the lower sliding portion 11 in the region where the lower recessed portion 30 is not formed. The value $(d_2-D_2)$ represents the depth of the lower recessed portion 30 in the radial direction of the shaft 1. The value $(D_2-R_2)$ represents half the width of the clearance (bearing clearance) between the lower journal portion 8 and the lower sliding portion 11 in the region where the upper recessed portion 30 is not formed. The upper limit of the depth of the lower recessed portion 30 is not particularly limited. It is $d_2-D_2 \leq 1.5$ mm, for example. Like the upper recessed portion 29, the lower recessed portion 30 having a depth of several hundred micrometers (for example, 200 μm) suffices.

Second Embodiment

Figure 7A:
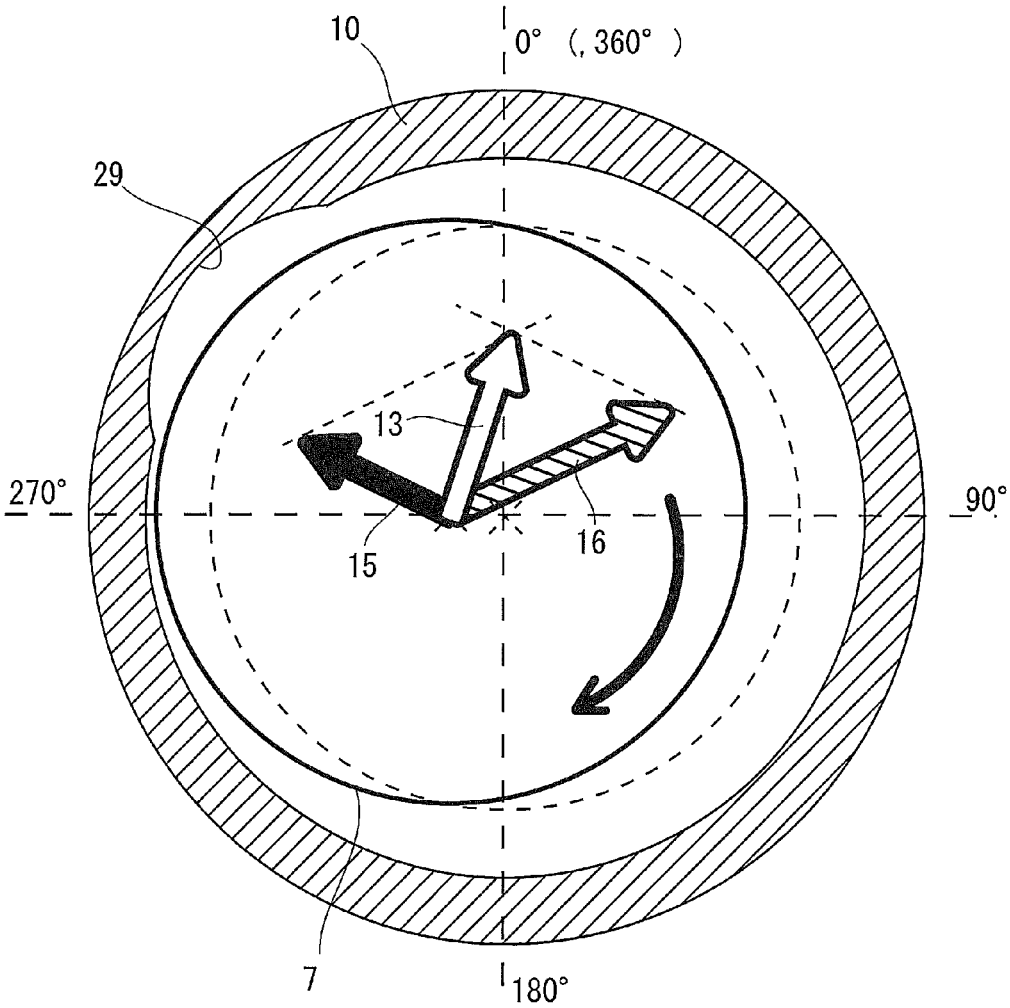
FIG. 7A is a transverse cross-sectional view of an upper journal portion and an upper sliding portion of a reciprocating compressor according to a second embodiment of the present invention.
Figure 7B:
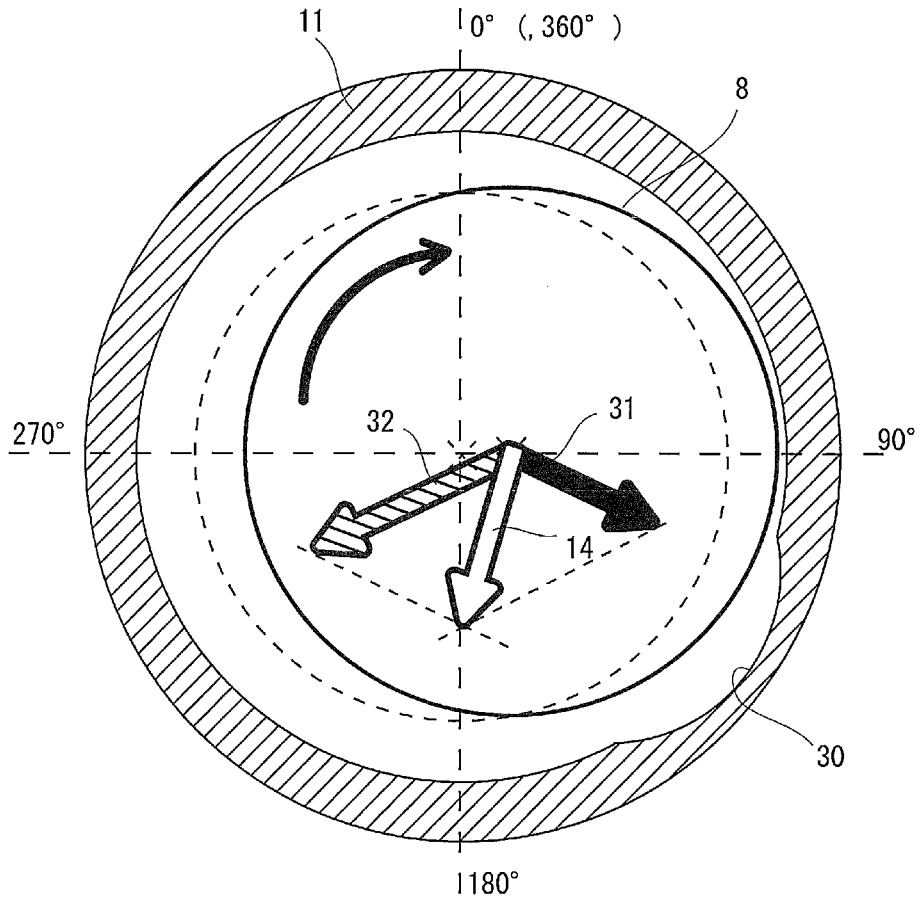
FIG. 7B is a transverse cross-sectional view of a lower journal portion and a lower sliding portion of the reciprocating compressor according to the second embodiment of the present invention.

As shown in FIG. 7A, in the second embodiment, the upper recessed portion 29 is located in the range of 270° to 360° in the rotational direction of the shaft 1 from the reference position (0°). As shown in FIG. 7B, the lower recessed portion 30 is located in the range of 90° to 180° in the rotational direction of the shaft 1 from the reference position. Since the other configurations are the same as those of the first embodiment, the description thereof is omitted.

As shown in FIG. 7A, since the upper journal portion 7 is eccentric in the direction of 270°, the upper sliding portion 10 in the range of more than 180° and less than 270° is involved in the generation of the positive pressure 16. The positive pressure 16 acts in a direction that is slightly inclined in the opposite direction to the rotational direction of the shaft 1, with respect to the counter-eccentric direction (direction of 90°). The upper sliding portion 10 in the range of 270° to 360° is involved in the generation of the negative pressure 15. The negative pressure 15 acts in a direction that is slightly inclined in the rotational direction of the shaft 1, with respect to the eccentric direction (direction of 270°) of the upper journal portion 7. Therefore, in the case where the upper recessed portion 29 is formed in the range of 270° to 360°, the effect of reducing friction losses can be obtained sufficiently.

As described in the first embodiment with reference to FIG. 3 and FIG. 5A, the upper recessed portion 29 partially overlaps the reduced diameter portion 9 in the axial direction. With this configuration, the pressure of the lubricating oil in the upper recessed portion 29 is equal to the pressure of the lubricating oil in the reduced diameter portion 9. The pressure of the lubricating oil in the reduced diameter portion 9 is approximately equal to the pressure in the closed casing 17 and higher than the negative pressure 15 that has been described with reference to FIG. 4A. That is, when the upper recessed portion 29 is located in the range of 270° to 360° in the rotational direction of the shaft 1 from the reference position and the upper recessed portion 29 overlaps the reduced diameter portion 9, the negative pressure 15 is suppressed.

As shown in FIG. 7A, the resultant force of the positive pressure 16 and the negative pressure 15 is the upper bearing holding force 13 in the upper journal portion 7. Since the negative pressure 15 is suppressed in the present embodiment, the negative pressure 15 is smaller than the positive pressure 16. Accordingly, the direction of action of the upper bearing holding force 13 is inclined toward the counter-eccentric direction. The more the direction of action of the upper bearing holding force 13 is inclined toward the counter-eccentric direction, the more the component of force in the direction in which the upper journal portion 7 is pushed away from the upper sliding portion 10 increases. The ability of the upper sliding portion 10 to support the upper journal portion 7 is increased accordingly. That is, according to the present embodiment, not only friction losses are reduced but also the ability of the upper sliding portion 10 to support the upper journal portion 7 is increased.

The same theory also applies to the lower recessed portion 30. As shown in FIG. 7B, since the lower journal portion 8 is eccentric in the direction of 90°, the lower sliding portion 11 in the range of more than 0° and less than 90° is involved in the generation of the positive pressure 32. The positive pressure 32 acts in a direction that is slightly inclined in the opposite direction to the rotational direction of the shaft 1, with respect to the counter-eccentric direction (direction of 270°). The lower sliding portion 11 in the range of 90° to 180° is involved in the generation of the negative pressure 31. The negative pressure 31 acts in a direction that is slightly inclined in the rotational direction of the shaft 1, with respect to the eccentric direction (direction of 90°) of the lower journal portion 8. Therefore, in the case where the lower recessed portion 30 is formed in the range of 90° to 180°, the effect of reducing friction losses can be obtained sufficiently.

As described in the first embodiment with reference to FIG. 3 and FIG. 5A, the lower recessed portion 30 partially overlaps the reduced diameter portion 9 in the axial direction. With this configuration, the negative pressure 31 is suppressed for the same reason as the case of the upper recessed portion 29.

As shown in FIG. 7B, the resultant force of the positive pressure 32 and the negative pressure 31 is the lower bearing holding force 14 in the lower journal portion 8. Since the negative pressure 31 is suppressed in the present embodiment, the negative pressure 31 is smaller than the positive pressure 32. Accordingly, the direction of action of the lower bearing holding force 14 is inclined toward the counter-eccentric direction. The more the direction of action of the lower bearing holding force 14 is inclined toward the counter-eccentric direction, the more the component of force in the direction in which the lower journal portion 8 is pushed away from the lower sliding portion 11 increases. The ability of the lower sliding portion 11 to support the lower journal portion 8 is increased accordingly. That is, according to the present embodiment, not only friction losses are reduced but also the ability of the lower sliding portion 11 to support the lower journal portion 8 is increased.

Only the upper recessed portion 29 may overlap the reduced diameter portion 9, or only the lower recessed portion 30 may overlap the reduced diameter portion 9.

According to Equation (4) and Equation (5) described above, the direction of action of the upper bearing holding force 13 is opposite to the direction of action of the load 12, and the direction of action of the lower bearing holding force 14 is the same as the direction of action of the load 12. As a result, the balance of the forces and the balance of the moments can be maintained. That is, in order to maintain the balance of the forces and the balance of the moments, the direction of action of the upper bearing holding force 13 is required to be the direction of 0°, and the direction of action of the lower bearing holding force 14 is required to be the direction of 180°.

In the present embodiment, as described with reference to FIG. 7A and FIG. 7B, the upper recessed portion 29 and the lower recessed portion 30 are provided at positions where the negative pressures 15 and 31 can be suppressed. Thereby, the directions of action of the upper bearing holding force 13 and the lower bearing holding force 14 are changed in the directions advantageous to support the shaft 1. Specifically, the upper bearing holding force 13 acts in a direction that is slightly inclined in the rotational direction of the shaft 1 from the direction of 0°. The lower bearing holding force 14 acts in a direction that is slightly inclined in the rotational direction of the shaft 1 from the direction of 180°. Therefore, apparently, the forces and the moments are out of balance.

In the entire shaft 1, however, the 90° direction component of the upper bearing holding force and the 270° direction component of the lower bearing holding force 14 are compensated for each other, and the 0° direction component of the upper bearing holding force 13 and the 180° direction component of the lower bearing holding force 14 are adjusted to each other. As a result, Equation (2) and Equation (3) are satisfied. Therefore, according to the present embodiment, the ability of the upper sliding portion 10 to support the upper journal portion 7 and the ability of the lower sliding portion 11 to support the lower journal portion 8 can be enhanced while maintaining the balance of the forces and the balance of the moments.

Third Embodiment

In the third embodiment, the positions of the upper recessed portion 29 and the lower recessed portion 30 are determined in consideration of the swing angle β of the connecting rod. Specifically, the upper recessed portion 29 is located in a range of 287° to 343° in the rotational direction of the shaft 1 from the reference position. The lower recessed portion 30 is located in a range of 107° to 163° in the rotational direction of the shaft 1 from the reference position. As in the second embodiment, the upper recessed portion 29 and the lower recessed portion 30 each overlap the reduced diameter portion 9 in the axial direction. Since the other configurations are the same as those of the first embodiment, the description thereof is omitted.

As described with reference to FIG. 2, the load 12 of the compressed refrigerant is transferred to the shaft 1 through the connecting rod 6. The direction of action of the load 12 on the shaft 1 is the direction of (180−β)° when it is represented using the connecting rod swing angle β. Since the connecting rod swing angle β changes according to the rotation angle θ of the shaft 1, the direction of action of the load 12 also changes according to the rotation angle θ of the shaft 1.

As described with reference to FIG. 3, in order for the shaft 1 to rotate while maintaining the balance of the forces and the balance of the moments, the direction of action of the upper bearing holding force 13 is required to be opposite to the direction of action of the load 12, and the direction of action of the lower bearing holding force 14 is required to be the same as the direction of action of the load 12.

The generality of the correlation among the eccentric direction of the shaft 1, the generation mechanism of the positive pressure and the negative pressure, and the directions of action of the bearing holding forces is also shown in the above-mentioned document written by Yamamoto, et al. Based on this correlation, the generation mechanism of the positive pressure 16 and the negative pressure 15 and the direction of action of the upper bearing holding force 13 in the case where the upper journal portion 7 is eccentric in the direction of an arbitrary angle $\psi_u$ are described. Furthermore, the generation mechanism of the positive pressure 32 and the negative pressure 31 and the direction of action of the lower bearing holding force 14 in the case where the lower journal portion 8 is eccentric in the direction of an arbitrary angle $\psi_l$ are described. The angles $\psi_u$ and $\psi_l$ each represent the direction specified by the rotation angle of the shaft 1 from the reference position (0°).

As shown in FIG. 4A, in the case where the upper journal portion 7 is eccentric in the direction of $\psi_u$°, in the range of more than $(\psi_u-90)$° and less than $\psi_u$°, the lubricating oil between the upper journal portion 7 and the upper sliding portion 10 is drawn in the direction in which the clearance between them is reduced and its pressure is high. Therefore, the upper sliding portion 10 in the range of more than $(\psi_u-90)$° and less than $\psi_u$° is involved in the generation of the positive pressure 16. On the other hand, in the range of $\psi_u$° to $(\psi_u+90)$°, the lubricating oil between the upper journal portion 7 and the upper sliding portion 10 is discharged in the direction in which the clearance between them is increased and its pressure is low. Therefore, the upper sliding portion 10 in the range of $\psi_u$° to $(\psi_u+90)$° is involved in the generation of the negative pressure 15. The upper bearing holding force 13 acts in the direction of $\phi_u$° ($\phi_u=\psi_u+90$)°.

As shown in FIG. 4B, in the case where the lower journal portion 8 is eccentric in the direction of $\psi_u$°, in the range of more than $(\psi_l-90)$° and less than $\psi_l$°, the lubricating oil between the lower journal portion 8 and the lower sliding portion 11 is drawn in the direction in which the clearance between them is reduced and its pressure is high. Therefore, the lower sliding portion 11 in the range of more than $(\psi_l-90)^\circ$ and less than $\psi_l^\circ$ is involved in the generation of the positive pressure 32. On the other hand, in the range of $\psi_l^\circ$ to $(\psi_l+90)^\circ$, the lubricating oil between the lower journal portion 8 and the lower sliding portion 11 is discharged in the direction in which the clearance between them is increased and its pressure is low. Therefore, the lower sliding portion 11 in the range of $\psi_l^\circ$ to $(\psi_l+90)^\circ$ is involved in the generation of the negative pressure 31. The lower bearing holding force 14 acts in the direction of $\phi_l^\circ$ $(\phi_l=\psi_l+90)^\circ$.

As described in the first embodiment, when $\psi_u$ is 270°, the upper sliding portion 10 in the ranges of 270° to 360° and 0° to 180° is not involved in the generation of the positive pressure 16 in theory, and makes a very small contribution to support the upper journal portion 7. When $\psi_l$ is 90°, the lower sliding portion 11 in the range of 90° to 360° is not involved in the generation of the positive pressure 32 in theory, and makes a very small contribution to support the lower journal portion 8.

On the other hand, when considering the connecting rod swing angle β, the direction of action of the load 12, the direction of action of the upper bearing holding force 13, the direction of action of the lower bearing holding force 14, the eccentric direction of the upper journal portion 7, the eccentric direction of the lower journal portion 8, the range of the upper sliding portion 10 that is involved in the generation of the negative pressure 15, and the range of the lower sliding portion 11 that is involved in the generation of the negative pressure 31 change in association with one another. The relations among them are shown in FIG. 8.

According to Kawahira, Mutsuyoshi, "Closed-type Refrigerators", Japanese Association of Refrigeration, 1981, p. 47, a typical range of Ic/S in a reciprocating compressor is 1.75 to 3.5. The smaller the value of Ic/S is, the larger the possible range of the connecting rod swing angle β is. That is, when Ic/S is 1.75, the possible range of the connecting rod swing angle β is maximum. Substituting Ic/S=1.75 in Equation (1) shown above yields $-1 \leq \sin\theta \leq 1$. Therefore, the possible range of β is about −17° to 17°. β has a positive value in the range of θ=0° to 180°, and a negative value in the range of θ=180° to 360°.

When the rotation angle θ of the shaft 1 is 0°, the connecting rod swing angle β, the direction of action of the load 12, the direction of action of the upper bearing holding force 13, the direction of action of the lower bearing holding force 14, the eccentric direction of the upper journal portion 7, and the eccentric direction of the lower journal portion 8 are the directions of 0°, 180°, 0°, 180°, 270°, and 90°, respectively. The range of the upper sliding portion 10 that is involved in the generation of the negative pressure 15 is 270° to 360°, and the range of the lower sliding portion 11 that is involved in the generation of the negative pressure 31 is 90° to 180°.

When the rotation angle θ of the shaft 1 is 90°, the connecting rod swing angle β, the direction of action of the load 12, the direction of action of the upper bearing holding force 13, the direction of action of the lower bearing holding force 14, the eccentric direction of the upper journal portion 7, and the eccentric direction of the lower journal portion 8 are the directions of 17°, 163°, 343°, 163°, 253°, and 73°, respectively. The range of the upper sliding portion 10 that is involved in the generation of the negative pressure 15 is 253° to 343° (see FIG. 9A), and the range of the lower sliding portion 11 that is involved in the generation of the negative pressure 31 is 73° to 163° (see FIG. 9B).

When θ is 90°, the range of the upper sliding portion 10 that is involved in the generation of the negative pressure 15 has a minimum end angle (343°). The range of the lower sliding portion 11 that is involved in the generation of the negative pressure 31 also has a minimum end angle (163°).

When the rotation angle θ of the shaft 1 is 180°, the connecting rod swing angle β, the direction of action of the load 12, the direction of action of the upper bearing holding force 13, the direction of action of the lower bearing holding force 14, the eccentric direction of the upper journal portion 7, and the eccentric direction of the lower journal portion 8 are the directions of 0°, 180°, 0°, 180°, 270°, and 90°, respectively. The range of the upper sliding portion 10 that is involved in the generation of the negative pressure 15 is 270° to 360°, and the range of the lower sliding portion 11 that is involved in the generation of the negative pressure 31 is 90° to 180°.

When the rotation angle θ of the shaft 1 is 270°, the connecting rod swing angle β, the direction of action of the load 12, the direction of action of the upper bearing holding force 13, the direction of action of the lower bearing holding force 14, the eccentric direction of the upper journal portion 7, and the eccentric direction of the lower journal portion 8 are the directions of −17°, which is the minimum value, 197°, 17°, 197°, 287°, and 107°, respectively. The range of the upper sliding portion 10 that is involved in the generation of the negative pressure 15 is 287° to 360° and 0° to 17° (see FIG. 10A), and the range of the lower sliding portion 11 that is involved in the generation of the negative pressure 31 is 107° to 197° (see FIG. 10B).

When θ is 270°, the range of the upper sliding portion 10 that is involved in the generation of the negative pressure 15 has a maximum start angle (287°). The range of the lower sliding portion 11 that is involved in the generation of the negative pressure 31 also has a maximum start angle (107°).

Figure 9A:
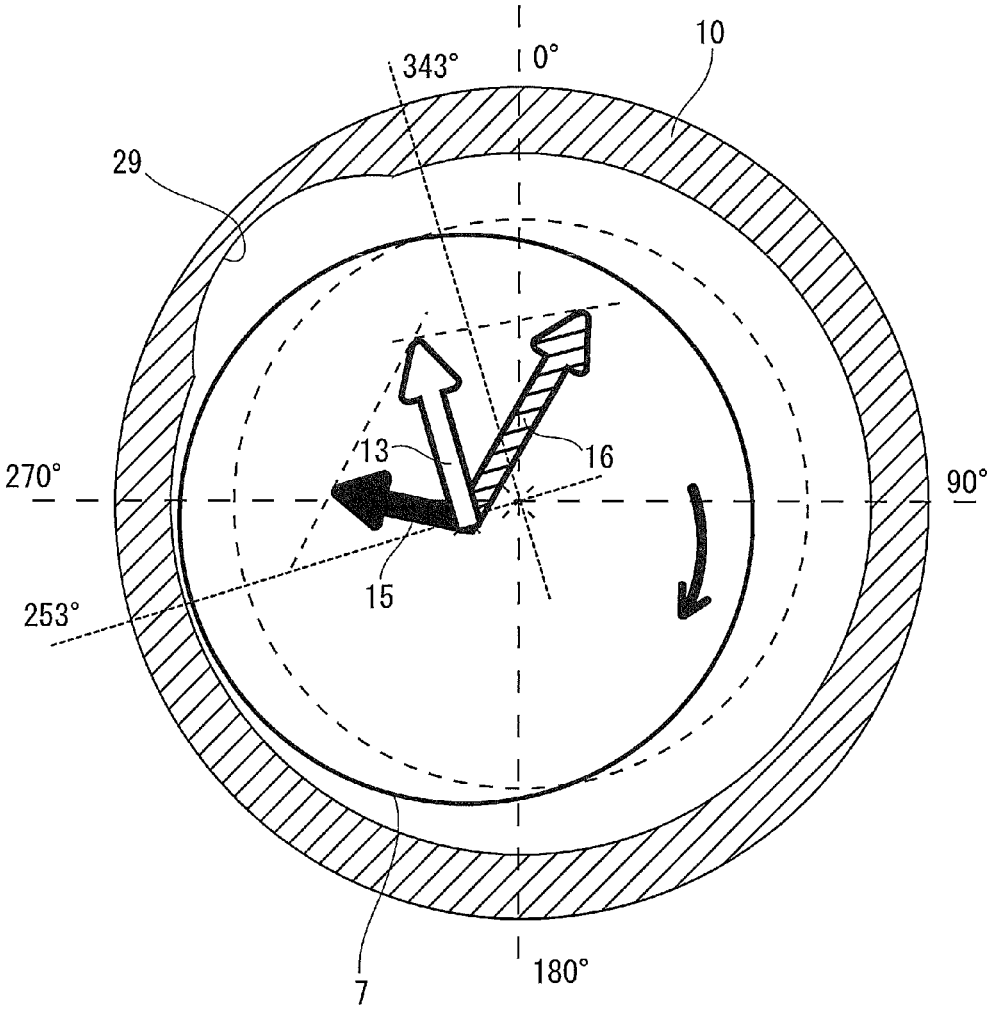
FIG. 9A is a transverse cross-sectional view (θ=90°) of an upper journal portion and an upper sliding portion of a reciprocating compressor according to a third embodiment of the present invention.
Figure 9B:
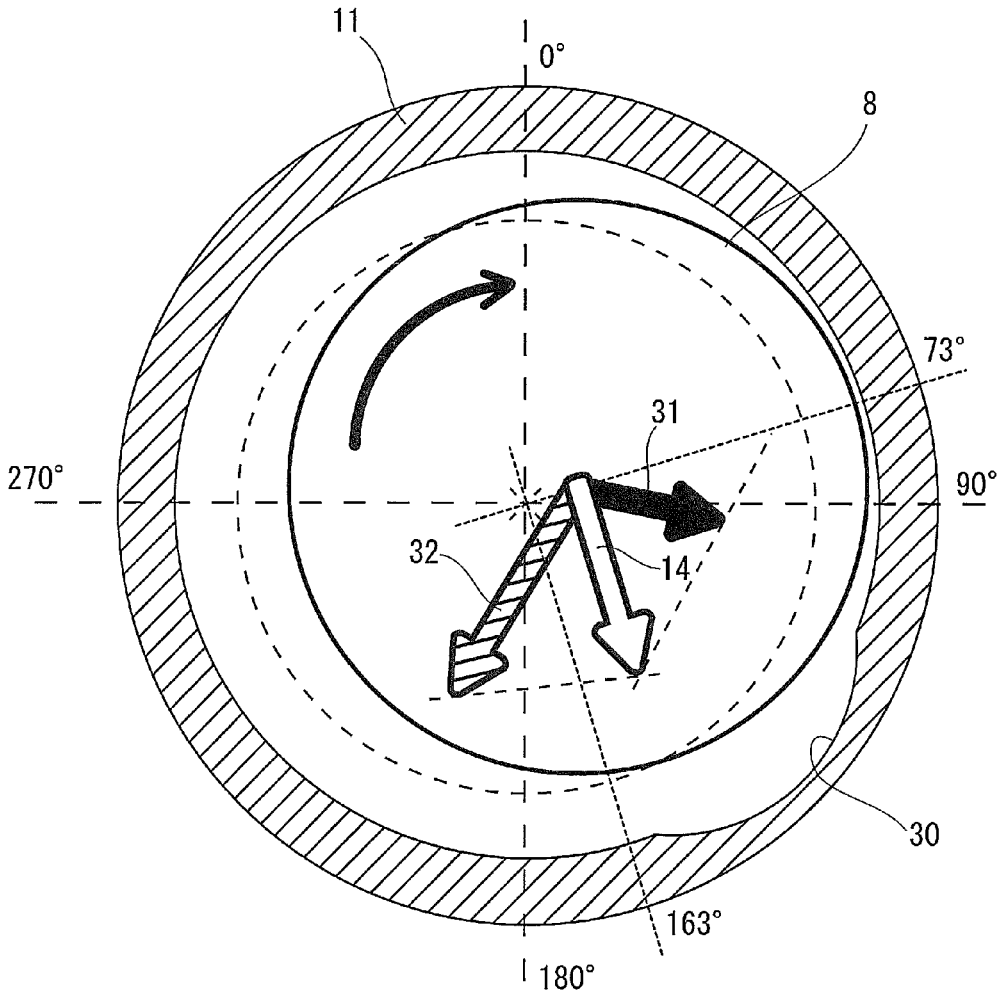
FIG. 9B is a transverse cross-sectional view (θ=90°) of a lower journal portion and a lower sliding portion of the reciprocating compressor according to the third embodiment of the present invention.
Figure 10A:
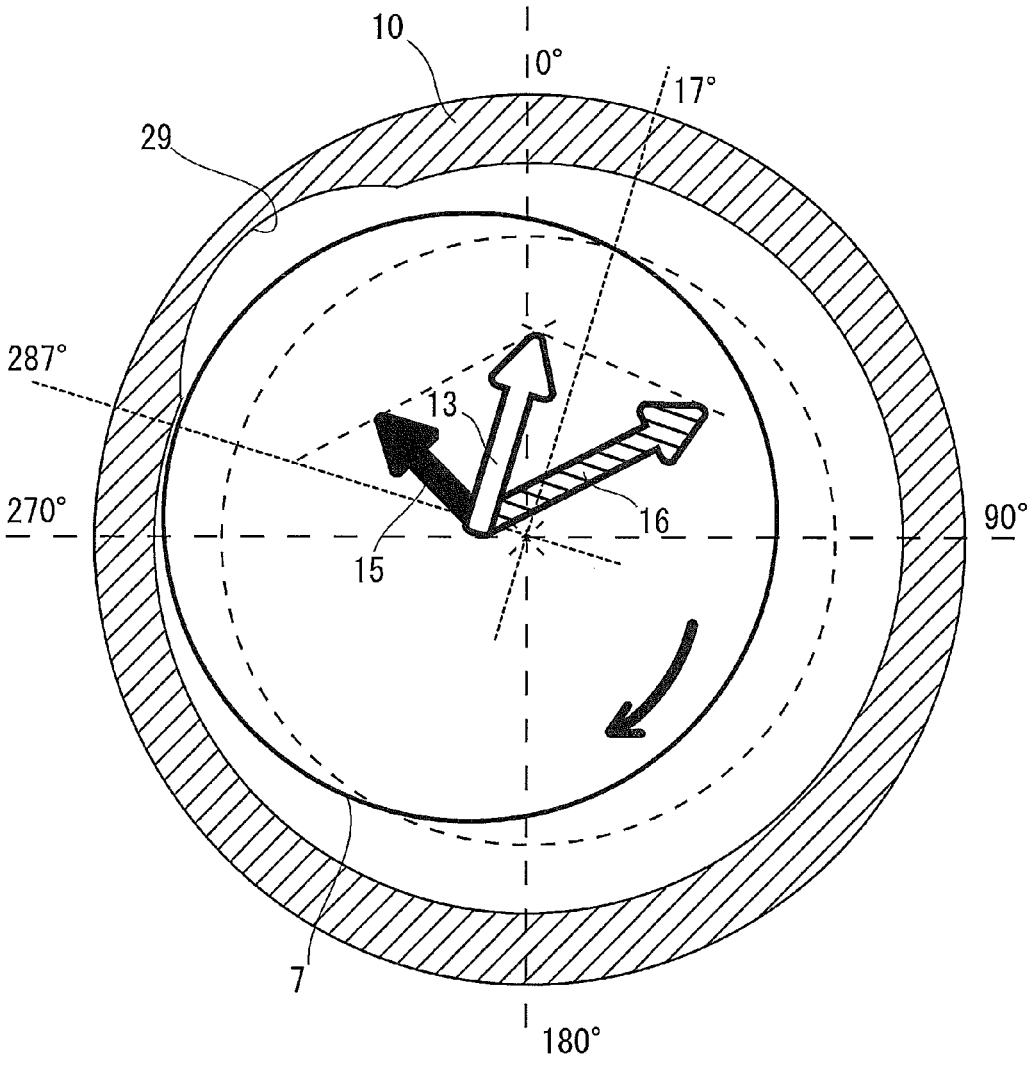
FIG. 10A is a transverse cross-sectional view (θ=270°) subsequent to FIG. 9A.
Figure 10B:
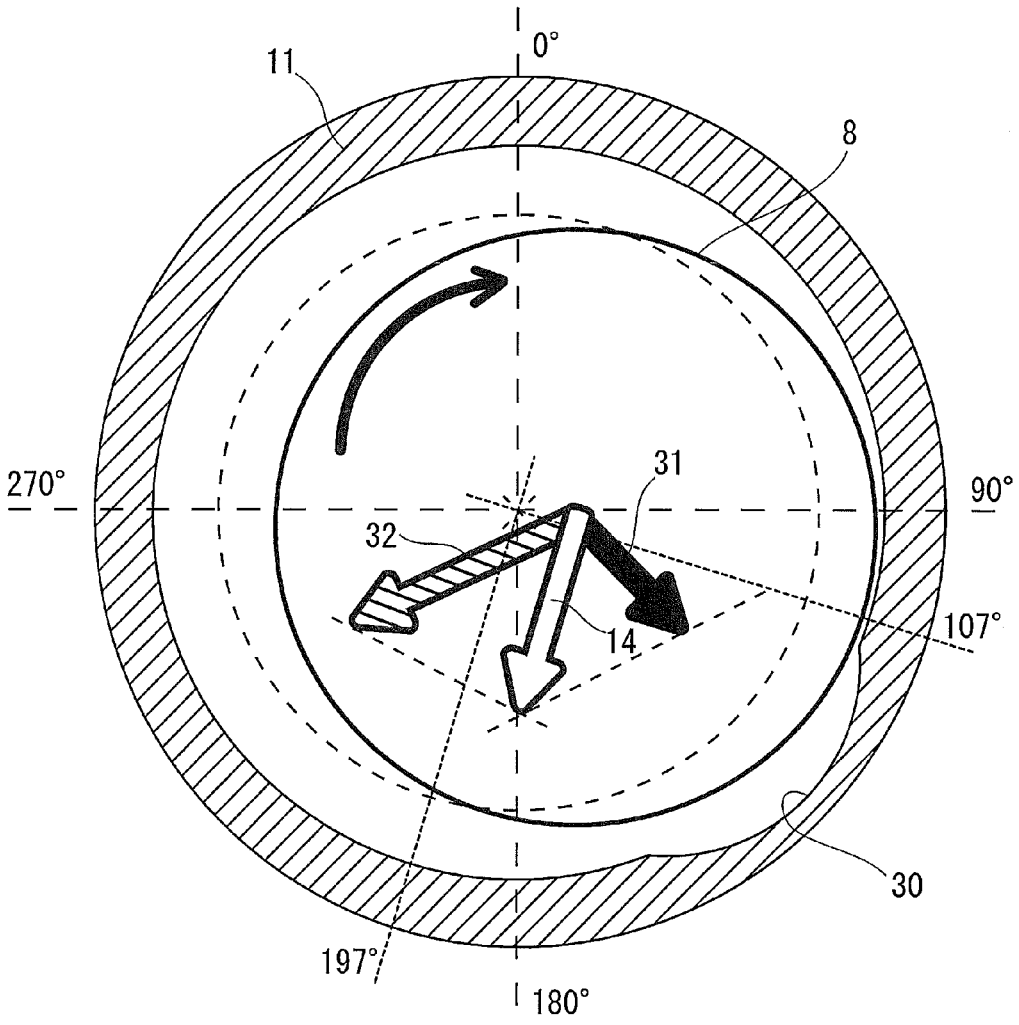
FIG. 10B is a transverse cross-sectional view (θ=270°) subsequent to FIG. 9B.

The eccentric direction of the upper journal portion 7 changes in the range of 253° to 287°, and the eccentric direction of the lower journal portion 8 changes in the range of 73° to 107°. Therefore, the shaft 1 rotates as if it were swinging. The upper sliding portion 10 in the range of 287° to 343° and the lower sliding portion 11 in the range of 107° to 163° are involved in the generation of the negative pressure 15 and the generation of the negative pressure 31, respectively, regardless of the rotation angle θ of the shaft 1. Therefore, as shown in FIG. 9A and FIG. 10A, if the upper recessed portion 29 is provided in the range of 287° to 343° in the rotational direction of the shaft 1 from the reference position, the friction losses can be reduced and the ability to support the shaft 1 can be enhanced more effectively. As shown in FIG. 9B and FIG. 10B, the lower recessed portion 30 can be provided in the range of 107° to 163° for the same reasons.

When the absolute value of the maximum value and the minimum value of the connecting rod swing angle β is Gabs, the positions of the upper recessed portion 29 and the lower recessed portion 30 can be generalized as follows. That is, it is preferable that the upper recessed portion 29 be located in the range of (270+βabs)° to (360−βabs)° in the rotational direction of the shaft 1 from the reference position, and that the lower recessed portion 30 be located in the range of (90+βabs)° to (180−βabs)° in the rotational direction of the shaft 1 from the reference position.

(Modification)

Figure 11A:
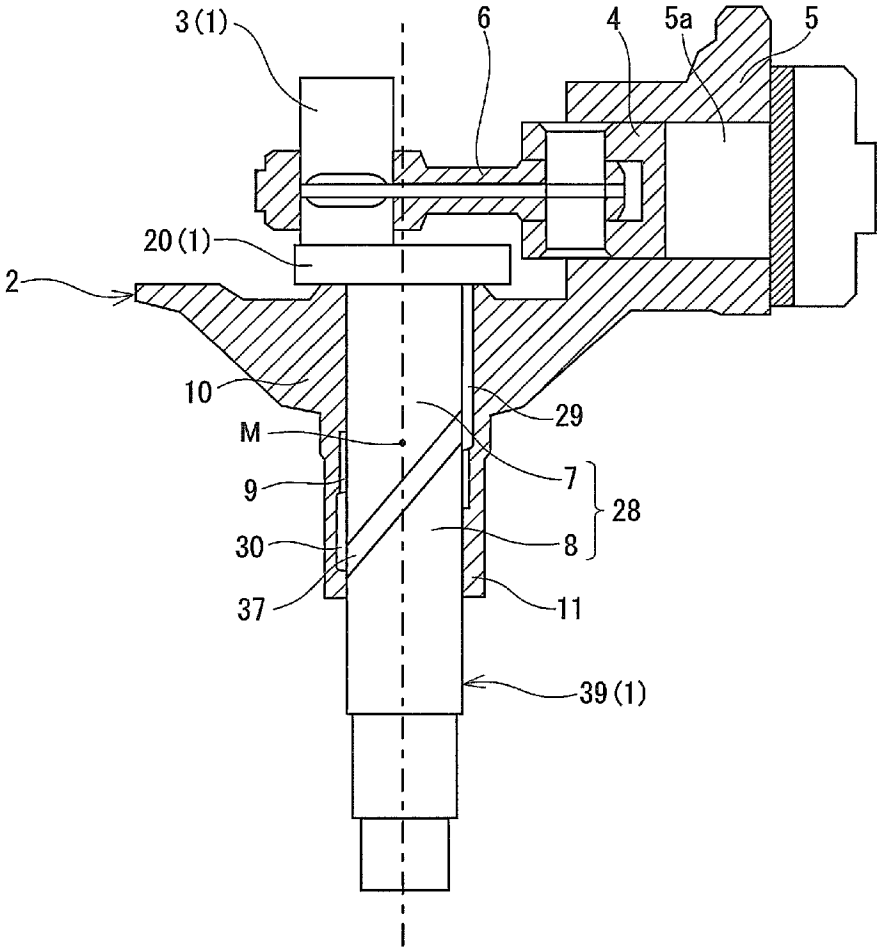
FIG. 11A is a longitudinal cross-sectional view of the main part of a reciprocating compressor according to a modification.

As shown in FIG. 11A, the reduced diameter portion 9 may be formed in the bearing 2. The reduced diameter portion 9 can be formed in the bearing 2 so that the bearing 2 is separated into the upper sliding portion 10 located closer to the connecting rod 6 than the reduced diameter portion 9 and the lower sliding portion 11 located farther from the connecting rod 6 than the reduced diameter portion 9. The inner diameter of the bearing 2 in the region where the reduced diameter portion 9 is formed is larger than that of the bearing 2 in the region where the reduced diameter portion 9 is not formed. The reduced diameter portions 9 may be formed in both of the shaft 1 and the bearing 2.

When the position of the shaft 1 in the axial direction is defined as a "height position", at the height position where the reduced diameter portion 9 is formed, the width of the clearance (bearing clearance) between the shaft 1 and the bearing 2 is constant in the circumferential direction of the shaft 1, except for the region where an oil supply groove is formed. In contrast, at the height positions where the upper recessed portion 29 and the lower recessed portion 30 are formed, the width of the bearing clearance is not constant in the circumferential direction of the shaft 1. Furthermore, the upper recessed portion 29 described in each of the embodiments is different from the reduced diameter portion 9 in that the former is provided in the upper sliding portion 10 for supporting the upper journal portion 7. Likewise, the lower recessed portion 30 is different from the reduced diameter portion 9 in that the former is provided in the lower sliding portion 11 for supporting the lower journal portion 8. These differences are based on the fact that the upper recessed portion 29 and the lower recessed portion 30 are selectively formed in the regions that make a small contribution to support the shaft 1.

Figure 11B:
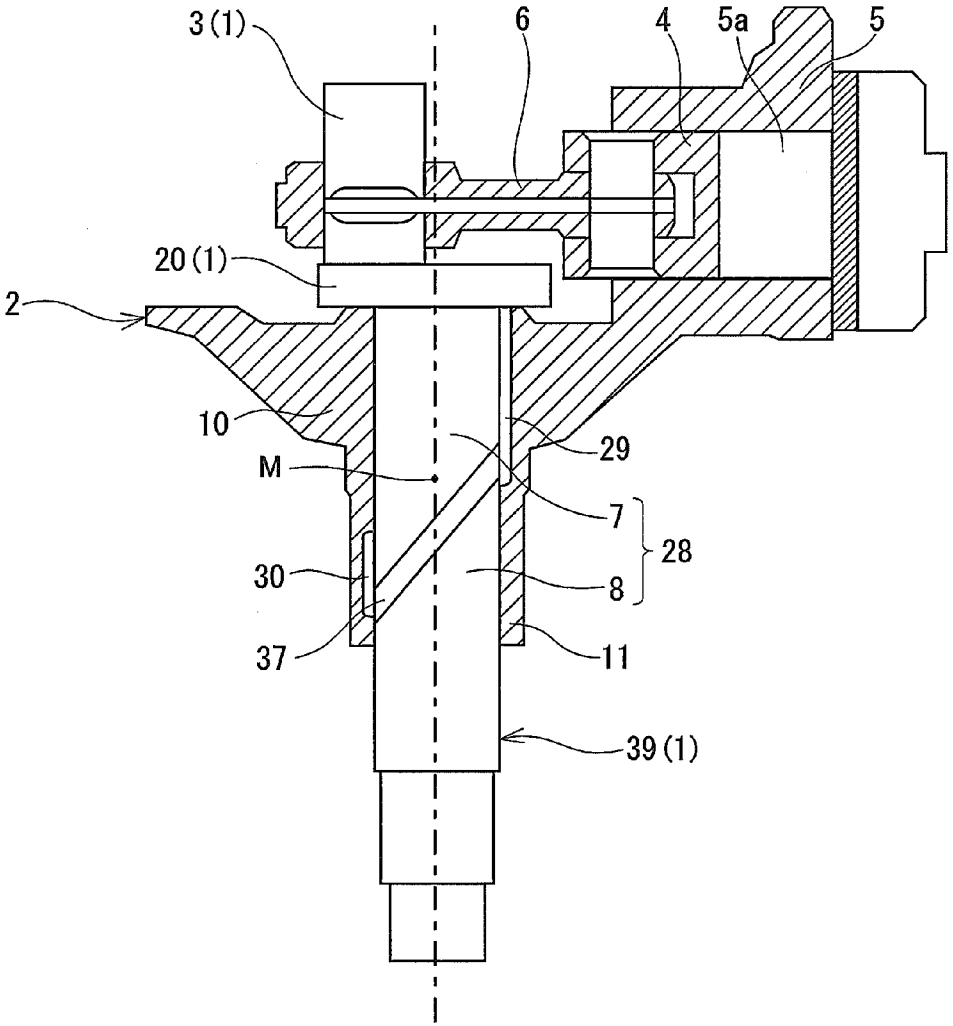
FIG. 11B is a longitudinal cross-sectional view of the main part of a reciprocating compressor according to another modification.

As shown in FIG. 11B, the shaft 1 having no reduced diameter portion can be applied to each of the embodiments. In the example of FIG. 11B, the reduced diameter portion is not formed also in the bearing 2. A portion located closer to the connecting rod 6 with respect to the midpoint M of the journal portion 28 in the direction parallel to the rotational axis of the shaft 1 is defined as the first journal portion 7, and a portion located farther from the connecting rod 6 with respect to the midpoint M is defined as the second journal portion 8. This definition of the journal portion 28 can be applied to the shaft 1, regardless of whether the reduced diameter portion is formed or not. The reduced diameter portion does not affect the generation directions of the upper bearing holding force 13 and the lower bearing holding force 14, respectively. Likewise, the reduced diameter portion does not affect the eccentric directions of the upper journal portion 7 and the lower journal portion 8, respectively. Therefore, the advantageous effects described in each of the embodiments can be obtained, regardless of whether the reduced diameter portion is formed or not.

Figure 11C:
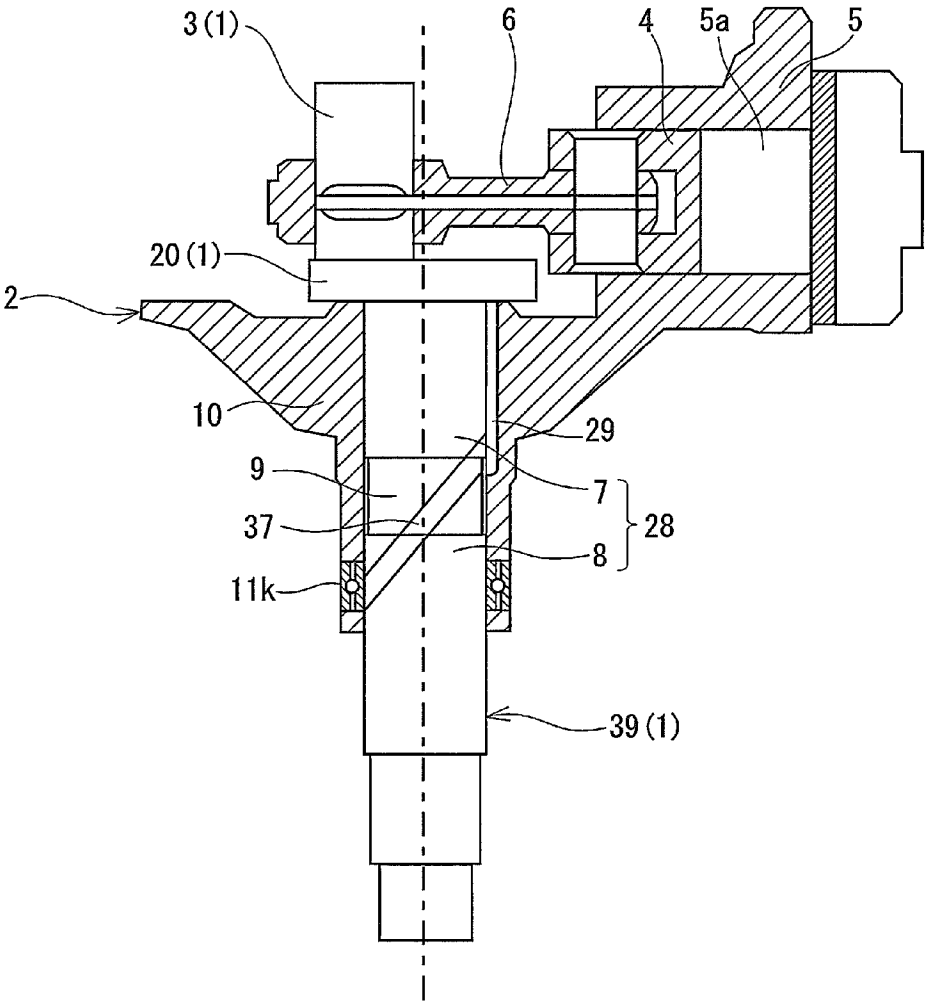
FIG. 11C is a longitudinal cross-sectional view of the main part of a reciprocating compressor according to still another modification.
Figure 12:
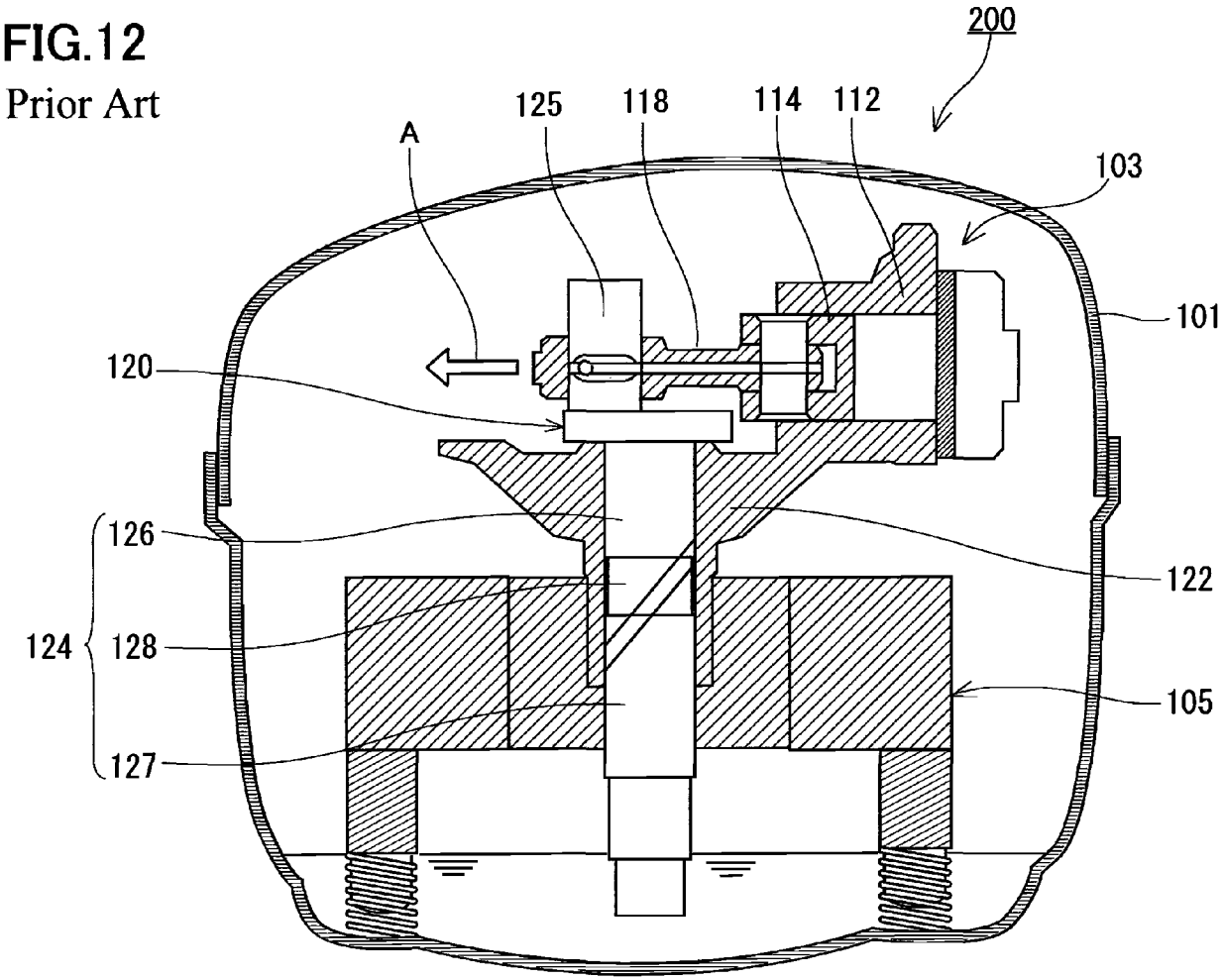
FIG.12 Prior Art
FIG. 12 is a longitudinal cross-sectional view of a conventional reciprocating compressor.

As shown in FIG. 11C, the bearing 2 may have a structure other than a sliding bearing, for example, a rolling bearing portion 11*k*, as a portion for supporting the lower journal portion 8. Also in this case, the upper recessed portion 29 formed in the upper sliding portion 10 can exert the effect of reducing friction losses.

It is preferable that the upper recessed portion 29 be formed only in the ranges described in each of the embodiments. For example, it is assumed that the upper recessed portion 29 is located in the range of 270° to 360° in the rotational direction of the shaft 1 from the reference position. In this case, it is preferable that the rest of the upper sliding portion 10 (the region in the angular range of more than 0° and less than 270°) having the same height position as the upper recessed portion 29 forms a bearing clearance having a constant width between that region and the shaft 1. With this configuration, only friction losses can be reduced effectively without causing a decrease in the bearing holding force. A plurality of recessed portions 29 may be formed in the angular ranges described in each of the embodiments. The same applies to the lower recessed portion 30.

The invention claimed is:

1. A reciprocating compressor comprising:

a cylinder;

a piston reciprocably disposed in the cylinder;

a connecting rod connected to the piston;

a shaft having a rotational axis perpendicular to a reciprocating direction of the piston, and connected to the connecting rod so that rotational motion of the shaft itself is converted into linear motion of the piston; and a bearing for supporting the shaft, wherein the reciprocating compressor is a cantilever type reciprocating compressor in which only one side of the shaft is supported by the bearing relative to the connecting rod, the shaft has a journal portion as a portion covered by the bearing, the journal portion has a first journal portion and a second journal portion, the first journal portion being closer to the connecting rod than the second journal portion, with respect to the rotational axis, the bearing has a first sliding portion for supporting the first journal portion and a second sliding portion for supporting the second journal portion, when a plane that is parallel to the reciprocating direction of the piston and includes the rotational axis of the shaft intersects an inner circumferential surface of the bearing at two circumferential positions and the circumferential position closer to the piston is defined as 0°, the first sliding portion has a first recessed portion in a range extending from 270° through 0° to 180° in a rotational direction of the shaft from 0°, when the rotational axis of the shaft coincides with a central axis of the bearing, the first recessed portion forms a larger bearing clearance than a bearing clearance formed in a range other than the ranges of 0° to 180° and 270° to 360°, the second sliding portion has a second recessed portion in a range extending from 90° through 180° to 360° in the rotational direction of the shaft from 0°, and when the rotational axis of the shaft coincides with a central axis of the bearing, the second recessed portion forms a larger bearing clearance than a bearing clearance formed in a range other than the range extending 90° through 180° to 360°.

2. The reciprocating compressor according to claim 1, wherein the first recessed portion is located in the range of 270° to 360° in the rotational direction of the shaft from 0°, and the second recessed portion is located in a range of 90° to 180° in the rotational direction of the shaft from 0°.

3. The reciprocating compressor according to claim 2, wherein when an absolute value of a maximum value and a minimum value of a swing angle of the connecting rod is βabs, the first recessed portion is located in a range of (270+βabs)° to (360−βabs)° in the rotational direction of the shaft from 0°, and the second recessed portion is located in a range of (90+βabs)° to (180−βabs)° in the rotational direction of the shaft from 0°.

4. The reciprocating compressor according to claim 2, wherein the first recessed portion is located in a range of 287° to 343° in the rotational direction of the shaft from 0°, and the second recessed portion is located in a range of 107° to 163° in the rotational direction of the shaft from 0°.

5. The reciprocating compressor according to claim 1, wherein the shaft further has a reduced diameter portion having a smaller outer diameter than the journal portion, the reduced diameter portion separates the journal portion in the bearing into the first journal portion and the second journal portion along the rotational axis, and the first recessed portion and the second recessed portion each partially overlap the reduced diameter portion in an axial direction of the shaft.

6. The reciprocating compressor according to claim 1, wherein a lower end of the second recessed portion is located above a lower end of the bearing in the axial direction of the shaft.

7. The reciprocating compressor according to claim 1, wherein the first recessed portion and the second recessed portion each have an arcuate surface profile in a cross section perpendicular to the rotational axis of the shaft.

8. The reciprocating compressor according to claim 1, wherein a relation $D_1-R_1 \leq d_1-D_1$ is satisfied, where $R_1$ is a radius of the first journal portion, $D_1$ is a radius of an inner circumference of the first sliding portion in a region where the first recessed portion is not formed, and $d_1$ is a distance from the rotational axis of the shaft to a deepest part of the first recessed portion.

9. The reciprocating compressor according to claim 1, wherein a relation $D_2-R_2 \leq d_2-D_2$ is satisfied, where $R_2$ is a radius of the second journal portion, $D_2$ is a radius of an inner circumference of the second sliding portion in a region where the second recessed portion is not formed, and $d_2$ is a distance from the rotational axis of the shaft to a deepest part of the second recessed portion.

10. A reciprocating compressor comprising:

a cylinder;

a piston reciprocably disposed in the cylinder;

a connecting rod connected to the piston;

a shaft having a rotational axis perpendicular to a reciprocating direction of the piston, and connected to the connecting rod so that rotational motion of the shaft itself is converted into linear motion of the piston; and a bearing for supporting the shaft, wherein the reciprocating compressor is a cantilever type reciprocating compressor in which only one side of the shaft is supported by the bearing relative to the connecting rod, the shaft has a journal portion as a portion covered by the bearing, the journal portion has a first journal portion and a second journal portion, the first journal portion being closer to the connecting rod than the second journal portion, with respect to the rotational axis, the bearing has a first sliding portion for supporting the first journal portion and a second sliding portion for supporting the second journal portion, when a plane that is parallel to the reciprocating direction of the piston and includes the rotational axis of the shaft intersects an inner circumferential surface of the bearing at two circumferential positions and the circumferential position closer to the piston is defined as 0°, the first sliding portion has a first recessed portion in a range extending from 270° through 0° to 180° in a rotational direction of the shaft from 0°, when the rotational axis of the shaft coincides with a central axis of the bearing, the first recessed portion forms a larger bearing clearance than a bearing clearance formed in a range other than the ranges of 0° to 180° and 270° to 360°, and a relation $D_1-R_1 \leq d_1-D_1$ is satisfied, where $R_1$ is a radius of the first journal portion, $D_1$ is a radius of an inner circumference of the first sliding portion in a region where the first recessed portion is not formed, and $d_1$ is a distance from the rotational axis of the shaft to a deepest part of the first recessed portion.

* * * * *